US010870933B2

(12) United States Patent
Bruce et al.

(10) Patent No.: US 10,870,933 B2
(45) Date of Patent: Dec. 22, 2020

(54) BRAIDING MACHINE AND METHOD OF FORMING AN ARTICLE INCORPORATING A MOVING OBJECT

(71) Applicant: NIKE, Inc., Beaverton, OR (US)

(72) Inventors: Robert M. Bruce, Portland, OR (US); Eun Kyung Lee, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/379,493

(22) Filed: Apr. 9, 2019

(65) Prior Publication Data

US 2019/0231031 A1 Aug. 1, 2019

Related U.S. Application Data

(62) Division of application No. 14/721,614, filed on May 26, 2015, now Pat. No. 10,280,538.

(51) Int. Cl.
*D04C 3/36* (2006.01)
*D04C 3/48* (2006.01)
(Continued)

(52) U.S. Cl.
CPC ..... *D04C 3/36* (2013.01); *A43B 23/042* (2013.01); *A43C 1/00* (2013.01); *D04C 1/02* (2013.01);
(Continued)

(58) Field of Classification Search
CPC ... D04C 3/36; D04C 3/42; D04C 3/44; D04C 3/46; D04C 3/48; D04C 1/02; A43B 23/0245; A43B 23/042; A43C 1/00
See application file for complete search history.

(56) References Cited

U.S. PATENT DOCUMENTS 165,941 A 7/1875 Malhebe
293,020 A 2/1884 Hedtmann
(Continued)

FOREIGN PATENT DOCUMENTS

CN 1090897 A 8/1994
CN 1093127 A 10/1994
(Continued)

OTHER PUBLICATIONS

Ricardo Bilton: "How 3D body scanning will help you find a suit that actually fits", May 2, 2013 (May 2, 2013), XP055241783, URL:http://venturebeat.com/2013/05/02/how-3d-body-scanning-will-help-you-find-a-suit-that-actually-fits/, Retrieved on Jan. 15, 2016.
(Continued)

*Primary Examiner* — Shaun R Hurley
(74) *Attorney, Agent, or Firm* — Shook, Hardy & Bacon L.L.P.

(57) ABSTRACT

A braiding machine comprising a support structure, a track, an enclosure, a plurality of rotor metals, and a passageway having a first opening and a second opening, and a method of forming an upper using a braiding machine, the method comprising braiding over a forming last that passes from a first side of a braiding point to a second side of the braiding point of the braiding machine. The braiding machine is capable of forming intricate braided structures and may include different sized rings and non-linear passageways through which a forming last passes. Multiple forming lasts may be attached together by connection mechanisms and passed through the braiding machine.

18 Claims, 23 Drawing Sheets

(51) Int. Cl.

| | |
|---|---|
| ***D04C 1/02*** | (2006.01) |
| ***D04C 3/42*** | (2006.01) |
| ***D04C 3/44*** | (2006.01) |
| ***D04C 3/46*** | (2006.01) |
| ***A43C 1/00*** | (2006.01) |
| ***A43B 23/04*** | (2006.01) |

(52) U.S. Cl.

CPC ..... *D04C 3/42* (2013.01); *D04C 3/44* (2013.01); *D04C 3/46* (2013.01); *D04C 3/48* (2013.01)

(56) References Cited

U.S. PATENT DOCUMENTS 329,739 A 11/1885 Henkels
376,372 A 1/1888 Dodge
450,685 A 4/1891 Steuss
810,056 A 1/1906 Janssen
847,005 A 3/1907 Kirberg
894,022 A 7/1908 Lepperhoff
920,994 A 5/1909 Prante
936,356 A 10/1909 Rahm
979,502 A 12/1910 Janssen et al.
1,117,330 A 11/1914 Cobb
1,318,888 A 10/1919 Le Carpentier
1,379,478 A 5/1921 Schevitz
1,527,344 A 2/1925 Bente et al.
1,538,160 A 5/1925 Bosebeck
1,554,325 A 9/1925 Bente
1,583,273 A 5/1926 Bosebeck
1,593,670 A 7/1926 Petersen
1,622,021 A 3/1927 Birkin et al.
1,637,716 A 8/1927 Turck
1,885,676 A 11/1932 Blaisdell
1,887,643 A 11/1932 Huber
2,022,350 A 11/1935 Huber
2,067,333 A 1/1937 Olson
2,091,215 A 8/1937 Price
2,188,640 A 1/1940 Bloch et al.
2,334,399 A 11/1943 Fether
2,788,700 A 4/1957 Crossley et al.
2,879,687 A 3/1959 Leimbach et al.
2,936,670 A 5/1960 Erwin
2,941,440 A 6/1960 Scanlon
2,960,905 A 11/1960 Scanlon
3,282,757 A 11/1966 Brussee
3,397,847 A 8/1968 Thaden
3,426,804 A 2/1969 Bluck
3,521,315 A 7/1970 Chatzimikes
3,541,247 A 11/1970 Manfred
3,586,058 A 6/1971 Ahrens et al.
3,714,862 A 2/1973 Berger
3,899,206 A 8/1975 Miura
3,943,361 A 3/1976 Miller
4,005,873 A 2/1977 Jacobsen et al.
4,275,638 A 6/1981 DeYoung
4,312,261 A 1/1982 Florentine
4,323,925 A 4/1982 Abell et al.
4,351,889 A 9/1982 Sundberg
4,366,476 A 12/1982 Hickin
4,494,436 A 1/1985 Kruesi
4,519,290 A 5/1985 Inman et al.
4,591,155 A 5/1986 Adachi
4,615,256 A 10/1986 Fukuta et al.
4,719,837 A 1/1988 McConnell et al.
4,847,063 A 7/1989 Smith
4,848,745 A 7/1989 Bohannan et al.
4,857,124 A 8/1989 Shobert et al.
4,884,309 A 12/1989 Shafir
4,885,973 A 12/1989 Spain
4,909,127 A 3/1990 Skelton et al.
4,916,997 A 4/1990 Spain
4,934,240 A 6/1990 Culp et al.
4,976,812 A 12/1990 McConnell et al.
4,992,313 A 2/1991 Shobert et al.
5,001,961 A 3/1991 Spain
5,067,525 A 11/1991 Tsuzuki et al.
5,121,329 A 6/1992 Crump
5,195,030 A 3/1993 White
5,203,249 A 4/1993 Adams et al.
5,257,571 A 11/1993 Richardson
5,287,790 A 2/1994 Akiyama et al.
5,348,056 A 9/1994 Tsuzuki
5,361,674 A 11/1994 Akiyama et al.
5,388,497 A 2/1995 Akiyama et al.
5,396,829 A 3/1995 Akiyama et al.
5,398,586 A 3/1995 Akiyama et al.
5,439,215 A 8/1995 Ratchford
5,476,027 A 12/1995 Uchida et al.
5,601,522 A 2/1997 Piramoon
5,833,295 A 11/1998 Farlow, Jr.
5,879,725 A 3/1999 Potter
5,885,622 A 3/1999 Daley
5,915,030 A 6/1999 Viebach
6,024,005 A 2/2000 Uozumi
6,029,375 A 2/2000 Borel
6,029,376 A 2/2000 Cass
6,345,598 B1 2/2002 Bogdanovich et al.
6,495,227 B1 12/2002 Cahuzac
6,510,961 B1 1/2003 Head et al.
6,679,152 B1 1/2004 Head et al.
6,696,001 B1 2/2004 Quddus
6,741,728 B1 5/2004 Genest
7,004,967 B2 2/2006 Chouinard et al.
7,069,935 B2 7/2006 Bousfield et al.
7,079,916 B2 7/2006 Stimpson
7,093,527 B2 8/2006 Rapaport et al.
7,204,903 B2 4/2007 Yasui
7,252,028 B2 8/2007 Bechtold et al.
7,262,353 B2 8/2007 Bartholomew et al.
7,300,014 B2 11/2007 Allen
7,347,011 B2 3/2008 Dua et al.
7,444,916 B2 11/2008 Hirukawa
7,566,376 B2 7/2009 Matsuoka
7,661,170 B2 2/2010 Goode et al.
7,793,576 B2 9/2010 Head et al.
7,815,141 B2 10/2010 Uozumi et al.
7,908,956 B2 3/2011 Dow et al.
7,938,853 B2 5/2011 Chouinard et al.
8,006,601 B2 8/2011 Inazawa et al.
8,061,253 B2 11/2011 Wybrow
8,192,572 B2 6/2012 Willey et al.
8,210,086 B2 7/2012 Head et al.
8,261,648 B1 9/2012 Marchand et al.
8,266,827 B2 9/2012 Dojan et al.
8,347,772 B2 1/2013 Dow et al.
8,394,222 B2 3/2013 Rettig
8,511,214 B2 8/2013 Gries
8,578,534 B2 11/2013 Langvin et al.
8,651,007 B2 2/2014 Adams
8,690,962 B2 4/2014 Dignam et al.
8,757,038 B2 6/2014 Siegismund
8,770,081 B2 7/2014 David et al.
8,789,452 B1 7/2014 Janardhan et al.
8,794,118 B2 8/2014 Dow et al.
8,808,482 B2 8/2014 Qi
9,144,284 B2 9/2015 Chung et al.
9,181,642 B2 11/2015 Cahuzac
9,572,402 B2 2/2017 Jarvis
9,788,603 B2 10/2017 Jarvis
2001/0026740 A1 10/2001 Yamanishi
2002/0020283 A1 2/2002 Uchida et al.
2002/0160068 A1 10/2002 Nakamura
2004/0200014 A1 10/2004 Pons
2004/0237760 A1 12/2004 Shimizu
2005/0039769 A1 2/2005 Bousfield et al.
2005/0178026 A1 8/2005 Friton
2005/0257674 A1 11/2005 Nishri et al.
2006/0052892 A1 3/2006 Matsushima et al.
2006/0061613 A1 3/2006 Fienup et al.
2008/0189194 A1 8/2008 Bentvelzen
2009/0193961 A1 8/2009 Jensen et al.
2009/0306762 A1 12/2009 McCullagh et al.
2010/0077634 A1 4/2010 Bell

(56) References Cited

U.S. PATENT DOCUMENTS

| | | | | |
|---|---|---|---|---|
| 2010/0095556 | A1 | 4/2010 | Jarvis | |
| 2010/0154256 | A1 | 6/2010 | Dua | |
| 2011/0005371 | A1 | 1/2011 | Giebels et al. | |
| 2011/0203446 | A1 | 8/2011 | Dow et al. | |
| 2011/0232008 | A1 | 9/2011 | Crisp | |
| 2012/0044622 | A1* | 2/2012 | Mori | G06F 1/1628 361/679.01 |
| 2012/0117822 | A1 | 5/2012 | Jarvis | |
| 2012/0233882 | A1 | 9/2012 | Huffa et al. | |
| 2013/0167710 | A1 | 7/2013 | Dow et al. | |
| 2013/0213144 | A1 | 8/2013 | Rice et al. | |
| 2013/0239790 | A1 | 9/2013 | Thompson et al. | |
| 2013/0258085 | A1 | 10/2013 | Leedy et al. | |
| 2013/0269159 | A1 | 10/2013 | Robitaille et al. | |
| 2013/0304232 | A1 | 11/2013 | Gries | |
| 2013/0305465 | A1 | 11/2013 | Siegismund | |
| 2013/0305911 | A1 | 11/2013 | Masson et al. | |
| 2014/0013931 | A1 | 1/2014 | Dow et al. | |
| 2014/0088688 | A1 | 3/2014 | Lilburn et al. | |
| 2014/0137434 | A1 | 5/2014 | Craig | |
| 2014/0182170 | A1 | 7/2014 | Wawrousek et al. | |
| 2014/0182447 | A1 | 7/2014 | Kang et al. | |
| 2014/0230634 | A1 | 8/2014 | Nakai | |
| 2014/0283671 | A1 | 9/2014 | Head et al. | |
| 2014/0373389 | A1 | 12/2014 | Bruce | |
| 2014/0377488 | A1 | 12/2014 | Jamison | |
| 2015/0007451 | A1 | 1/2015 | Bruce | |
| 2015/0033933 | A1 | 2/2015 | Kobayashi | |
| 2015/0040746 | A1 | 2/2015 | Kirth et al. | |
| 2015/0045831 | A1 | 2/2015 | Allen | |
| 2015/0101134 | A1 | 4/2015 | Manz et al. | |
| 2015/0299916 | A1 | 10/2015 | Reinisch | |
| 2016/0076178 | A1 | 3/2016 | Head et al. | |
| 2016/0158769 | A1 | 6/2016 | Hornek et al. | |
| 2016/0166000 | A1 | 6/2016 | Bruce et al. | |
| 2016/0166011 | A1 | 6/2016 | Bruce et al. | |
| 2016/0168769 | A1 | 6/2016 | McDonnell | |
| 2016/0251786 | A1 | 9/2016 | Ichikawa | |
| 2016/0289873 | A1 | 10/2016 | Head | |
| 2016/0345676 | A1 | 12/2016 | Bruce et al. | |
| 2016/0348288 | A1 | 12/2016 | Lee | |
| 2017/0037548 | A1 | 2/2017 | Lee | |
| 2018/0014609 | A1 | 1/2018 | Bruce et al. | |

FOREIGN PATENT DOCUMENTS

| | | | |
|---|---|---|---|
| CN | 2206796 | Y | 9/1995 |
| CN | 2532562 | Y | 1/2003 |
| CN | 201883267 | U | 6/2011 |
| CN | 203746888 | U | 7/2014 |
| DE | 726634 | C | 10/1942 |
| DE | 2162170 | A1 | 6/1973 |
| DE | 3843488 | A1 | 7/1990 |
| DE | 4306286 | A1 | 9/1993 |
| EP | 1486601 | A1 | 12/2004 |
| EP | 2657384 | A1 | 10/2013 |
| GB | 191423221 | A | 11/1915 |
| GB | 161552 | A | 12/1921 |
| GB | 477556 | A | 1/1938 |
| GB | 1196983 | A | 7/1970 |
| JP | H04174749 | A | 6/1992 |
| JP | 8-284051 | A | 10/1996 |
| JP | H0995844 | A | 4/1997 |
| JP | 10158965 | A | 6/1998 |
| JP | 11350317 | A | 12/1999 |
| JP | 2004305449 | A | 11/2004 |
| JP | 2008240187 | A | 10/2008 |
| JP | 2013147760 | A | 8/2013 |
| KR | 20020038168 | A | 5/2002 |
| TW | I264994 | B | 11/2006 |
| TW | M305221 | U | 1/2007 |
| TW | M447894 | U | 3/2013 |
| TW | 201321717 | A | 6/2013 |
| TW | 201328624 | A | 7/2013 |
| TW | M473088 | U | 3/2014 |
| TW | M487651 | U | 10/2014 |
| WO | 0153583 | A1 | 7/2001 |
| WO | 2008052947 | A1 | 5/2008 |
| WO | 2009000371 | A1 | 12/2008 |
| WO | 2011103272 | A1 | 8/2011 |
| WO | 2011111564 | A1 | 9/2011 |
| WO | 2012/086117 | A1 | 6/2012 |
| WO | 2014008331 | A2 | 1/2014 |
| WO | 2014137825 | A2 | 9/2014 |

OTHER PUBLICATIONS

Anonymous: "3D print shoe last", styleforum, Feb. 19, 2014 (Feb. 19, 2014), pp. 1-4, XP055241611, Retrieved from the Internet on Jan. 14, 2016: URL:http://www.styleforum.net/t/137783/3dprint-shoe-last.

Braniscomb et al., "New Directions in Braiding", Journal of Engineered Fibers and Fabrics, vol. 8, No. 2, 2013, pp. 11-24.

Non-Final Office Action received for U.S. Appl. No. 15/691,049, dated Jun. 8, 2020, 12 pages.

Office Action received for Indian Patent Application No. 201747019936, dated Jun. 12, 2020, 8 pages.

Office Action received for Indian Patent Application No. 201747020245, dated Jun. 16, 2020, 7 pages.

* cited by examiner

BRAIDING MACHINE AND METHOD OF FORMING AN ARTICLE INCORPORATING A MOVING OBJECT

CROSS-REFERENCE TO RELATED APPLICATIONS AND PRIORITY CLAIM

This Non-Provisional Patent Application is a divisional of co-pending U.S. patent application Ser. No. 14/721,614, filed May 26, 2015, titled "Braiding Machine and Method of Forming an Article Incorporating a Moving Object," the contents of which is incorporated herein by reference in the entirety.

BACKGROUND

Conventional articles of footwear generally include two primary elements: an upper and a sole structure. The upper and the sole structure, at least in part, define a foot-receiving chamber that may be accessed by a user's foot through a foot-receiving opening.

The upper is secured to the sole structure and forms a void on the interior of the footwear for receiving a foot in a comfortable and secure manner. The upper member may secure the foot with respect to the sole member. The upper may extend around the ankle, over the instep and toe areas of the foot. The upper may also extend along the medial and lateral sides of the foot as well as the heel of the foot. The upper may be configured to protect the foot and provide ventilation, thereby cooling the foot. Further, the upper may include additional material to provide extra support in certain areas.

The sole structure is secured to a lower area of the upper, thereby positioned between the upper and the ground. The sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

A variety of material elements (e.g., textiles, polymer foam, polymer sheets, leather, synthetic leather) are conventionally utilized in manufacturing the upper. In athletic footwear, for example, the upper may have multiple layers that each includes a variety of joined material elements. As examples, the material elements may be selected to impart stretch resistance, wear resistance, flexibility, air permeability, compressibility, comfort, and moisture wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas.

As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and number of material elements. Further, multiple pieces that are stitched together may cause a greater concentration of forces in certain areas. The stitch junctions may transfer stress at an uneven rate relative to other parts of the article of footwear, which may cause failure or discomfort. Additional material and stitch joints may lead to discomfort when worn. By decreasing the number of material elements utilized in the upper, waste may be decreased while increasing the manufacturing efficiency, the comfort, performance, and the recyclability of the upper.

SUMMARY

In one aspect, a braiding machine includes a support structure. The support structure includes a track and an enclosure. The track defines a plane and the track extends around the enclosure. Further a plurality of rotor metals are arranged along the track. A passageway extends through the plane from a first side of the plane to a second side of the plane. A first opening of the passageway is located on the first side. A second opening of the passageway being located on the second side. The passageway is configured to accept a three-dimensional object. The second opening is located proximate to a braiding point. Additionally, the plurality of rotor metals includes a first rotor metal and a second rotor metal. The first rotor metal is adjacent to the second rotor metal. As the first rotor metal rotates the second rotor metal remains stationary.

In another aspect, a method of forming a braided upper using a braiding machine is disclosed. The method includes locating a three-dimensional object adjacent a first opening of a passageway. The passageway extending through an enclosure of the braiding machine. Further, a track of the braiding machine extends around the enclosure. The method further includes passing the three-dimensional object through the passageway from the first opening to a second opening. Additionally the method includes passing the three-dimensional object from a first side of a braiding point to a second side of the braiding point of the braiding machine. The braiding machine further includes a plurality of spools located along the track. The plurality of spools includes a first spool and a second spool. The first spool being adjacent to the second spool. As the first spool moves the second spool remains stationary. As each of the plurality of spools is passed around the track, thread is deposited around the three-dimensional object In another aspect, a method of forming an article of footwear using a braiding machine is disclosed. The method includes passing a last from a first side of a ring to a second side of the ring of the braiding machine. The braiding machine includes a plurality of rotor metals. The plurality of rotor metals includes a first rotor metal and a second rotor metal. The first rotor metal is adjacent to the second rotor metal. The plurality of rotor metals is configured so that as the first rotor metal rotates the second rotor metal remains stationary. The method further includes forming a braided component. A portion of the braided component forms a braided portion over the last. The method additionally includes removing the braided portion from the braided component.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale; emphasis instead is being placed upon illustrating the principles of the embodiments. Moreover, in the Figures, like reference numerals designate corresponding parts throughout the different views.

DETAILED DESCRIPTION

Figure 1:
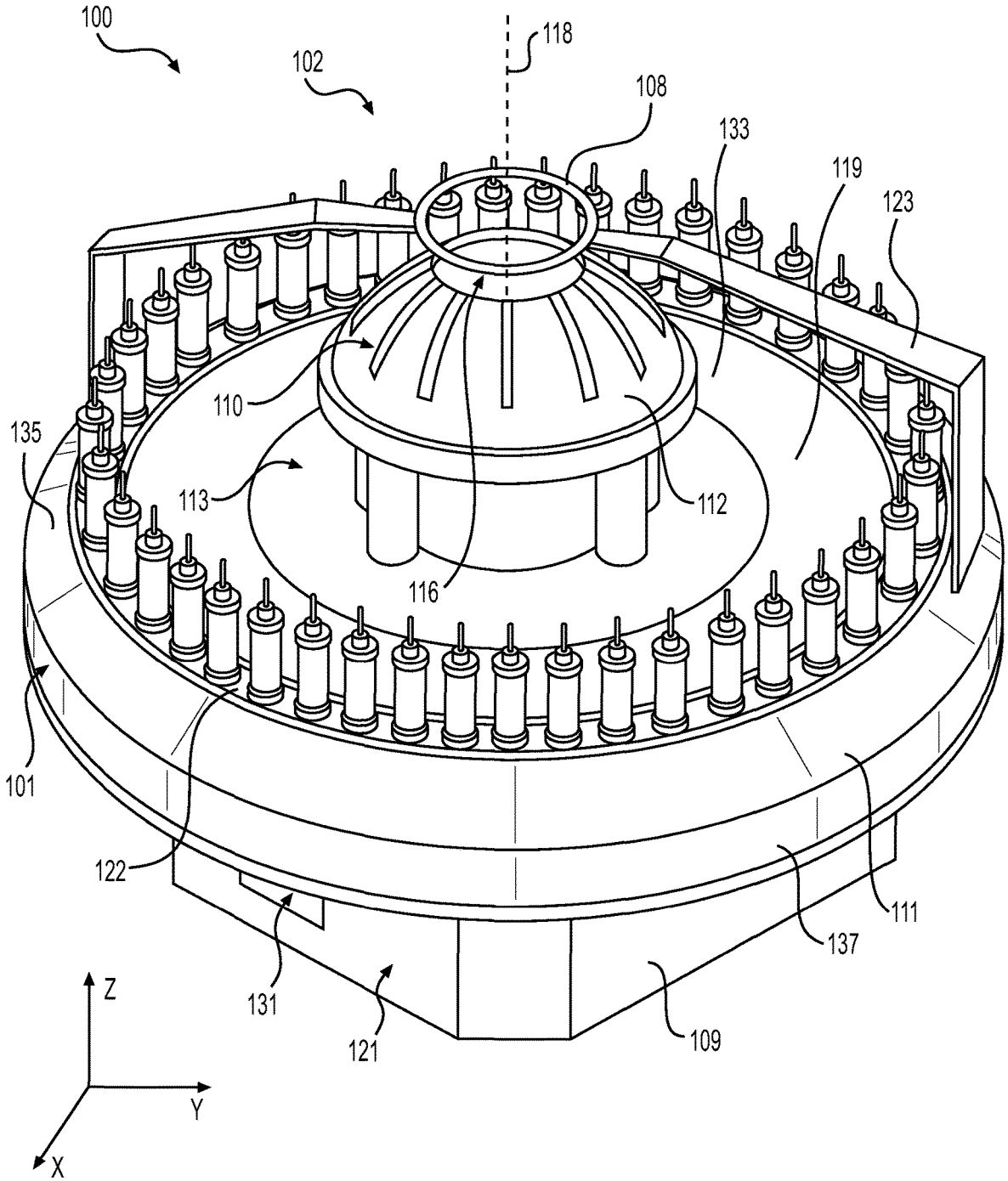
FIG. 1 is an isometric schematic view of an embodiment of a braiding machine.

For clarity, the detailed descriptions herein describe certain exemplary embodiments, but the disclosure herein may be applied to any article of footwear comprising certain features described herein and recited in the claims. In particular, although the following Detailed Description discusses exemplary embodiments in the form of footwear such as running shoes, jogging shoes, tennis, squash or racquetball shoes, basketball shoes, sandals, and flippers, the disclosures herein may be applied to a wide range of footwear or possibly other kinds of articles.

The term "sole" as used herein shall refer to any combination that provides support for a wearer's foot and bears the surface that is in direct contact with the ground or playing surface, such as a single sole; a combination of an outsole and an inner sole; a combination of an outsole, a midsole, and an inner sole; and a combination of an outer covering, an outsole, a midsole, and an inner sole.

The term "overbraid" as used herein shall refer to a method of braiding that forms along the shape of a three-dimensional structure. An object that is overbraided includes a braid structure that extends around the outer surface of an object. An object that is overbraided does not necessarily include a braided structure encompassing the entire object; rather, an object that is overbraided includes a seamless braided structure that extends from the back to the front of the object.

The detailed description and the claims may make reference to various kinds of tensile elements, braided structures, braided configurations, braided patterns, and braiding machines.

As used herein, the term "tensile element" refers to any kinds of threads, yarns, strings, filaments, fibers, wires, cables as well as possibly other kinds of tensile elements described below or known in the art. As used herein, tensile elements may describe generally elongated materials with lengths much greater than corresponding diameters. In some embodiments, tensile elements may be approximately one-dimensional elements. In some other embodiments, tensile elements may be approximately two-dimensional (e.g., with thicknesses much less than their lengths and widths). Tensile elements may be joined to form braided structures. A "braided structure" may be any structure formed intertwining three or more tensile elements together. Braided structures could take the form of braided cords, ropes, or strands. Alternatively, braided structures may be configured as two-dimensional structures (e.g., flat braids) or three-dimensional structures (e.g., braided tubes) such as with lengths and widths (or diameters) significantly greater than their thicknesses.

A braided structure may be formed in a variety of different configurations. Examples of braided configurations include, but are not limited to, the braiding density of the braided structure, the braid tension(s), the geometry of the structure (e.g., formed as a tube, an article, etc.), the properties of individual tensile elements (e.g., materials, cross-sectional geometry, elasticity, tensile strength, etc.) as well as other features of the braided structure. One specific feature of a braided configuration may be the braid geometry, or braid pattern, formed throughout the entirety of the braided configuration or within one or more regions of the braided structure. As used herein, the term "braid pattern" refers to the local arrangement of tensile strands in a region of the braided structure. Braid patterns can vary widely and may differ in one or more of the following characteristics: the orientations of one or more groups of tensile elements (or strands), the geometry of spaces or openings formed between braided tensile elements, the crossing patterns between various strands as well as possibly other characteristics. Some braided patterns include lace-braided or jacquard patterns, such as Chantilly, Bucks Point, and Torchon. Other patterns include biaxial diamond braids, biaxial regular braids, as well as various kinds of triaxial braids.

Braided structures may be formed using braiding machines. As used herein, a "braiding machine" is any machine capable of automatically intertwining three or more tensile elements to form a braided structure. Braiding machines may generally include spools, or bobbins, that are moved or passed along various paths on the machine. As the spools are passed around, tensile strands extending from the spools toward a center of the machine may converge at a "braiding point" or braiding area. Braiding machines may be characterized according to various features, including spool control and spool orientation. In some braiding machines, spools may be independently controlled so that each spool can travel on a variable path throughout the braiding process, hereafter referred to as "independent spool control." Other braiding machines, however, may lack independent spool control, so that each spool is constrained to travel along a fixed path around the machine. Additionally, in some braiding machines, the central axes of each spool point in a common direction so that the spool axes are all parallel, hereby referred to as an "axial configuration." In other braiding machines, the central axis of each spool is oriented toward the braiding point (e.g., radially inward from the perimeter of the machine toward the braiding point), hereby referred to as a "radial configuration."

One type of braiding machine that may be utilized is a radial braiding machine or radial braider. A radial braiding machine may lack independent spool control and may, therefore, be configured with spools that pass in fixed paths around the perimeter of the machine. In some cases, a radial braiding machine may include spools arranged in a radial configuration. For purposes of clarity, the detailed description and the claims may use the term "radial braiding machine" to refer to any braiding machine that lacks independent spool control. The present embodiments could make use of any of the machines, devices, components, parts, mechanisms, and/or processes related to a radial braiding machine as disclosed in Dow et al., U.S. Pat. No. 7,908,956, issued Mar. 22, 2011, and titled "Machine for Alternating Tubular and Flat Braid Sections," and as disclosed in Richardson, U.S. Pat. No. 5,257,571, issued Nov. 2, 1993, and titled "Maypole Braider Having a Three Under and Three Over Braiding path," the entirety of each application being herein incorporated by reference. These applications may be hereafter referred to as the "Radial Braiding Machine" applications.

Another type of braiding machine that may be utilized is a lace braiding machine, also known as a Jacquard or Torchon braiding machine. In a lace braiding machine the spools may have independent spool control. Some lace braiding machines may also have axially arranged spools. The use of independent spool control may allow for the creation of braided structures, such as lace braids, that have an open and complex topology, and may include various kinds of stitches used in forming intricate braiding patterns. For purposes of clarity, the detailed description and the claims may use the term "lace braiding machine" to refer to any braiding machine that has independent spool control. The present embodiments could make use of any of the machines, devices, components, parts, mechanisms, and/or processes related to a lace braiding machine as disclosed in Ichikawa, EP Patent Number 1486601, published on Dec. 15, 2004, and titled "Torchon Lace Machine," and as disclosed in Malhere, U.S. Pat. No. 165,941, issued Jul. 27, 1875, and titled "Lace-Machine," the entirety of each application being herein incorporated by reference. These applications may be hereafter referred to as the "Lace Braiding Machine" applications.

Spools may move in different ways according to the operation of a braiding machine. In operation, spools that are moved along a constant path of a braiding machine may be said to undergo "non-jacquard motions," while spools that move along variable paths of a braiding machine are said to undergo "jacquard motions." Thus, as used herein, a lace braiding machine provides means for moving spools in jacquard motions, while a radial braiding machine can only move spools in non-jacquard motions. Additionally a jacquard portion or structure refers to a portion formed through the individual control of each thread. Additionally, a non-jacquard portion may refer to a portion formed without individual control of threads. Additionally, a non-jacquard portion may refer to a portion formed on a machine that utilizes the motion of a non-jacquard machine.

The embodiments may also utilize any of the machines, devices, components, parts, mechanisms, and/or processes related to a braiding machine as disclosed in U.S. patent application Ser. No. 14/721,563 filed May 26, 2015, titled "Braiding Machine and Method of Forming an Article Incorporating Braiding Machine," the entirety of which is herein incorporated by reference and hereafter referred to as the "Fixed Last Braiding" application.

Referring to FIG. 1, a braiding machine is depicted. Braiding machine 100 includes a plurality of spools 102. Plurality of spools 102 include threads 120 (see FIG. 2). Threads 120 may be wrapped around plurality of spools 102 such that as threads 120 are tensioned or pulled, threads 120 may unwind or unwrap from plurality of spools 102. Threads 120 may be oriented to extend through ring 108 and form a braided structure.

Threads 120 may be formed of different materials. The properties that a particular type of thread will impart to an area of a braided component partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the thread selected for formation of a braided component may affect the properties of the braided component. For example, a thread may be a monofilament thread or a multifilament thread. The thread may also include separate filaments that are each formed of different materials. In addition, the thread may include filaments that are each formed of two or more different materials, such as a bicomponent thread with filaments having a sheath-core configuration or two halves formed of different materials.

In some embodiments, plurality of spools 102 may be located in a position guiding system. In some embodiments, plurality of spools 102 may be located within a track. As shown, track 122 may secure plurality of spools 102 such that as threads 120 are tensioned or pulled, plurality of spools 102 may remain within track 122 without falling over or becoming dislodged.

In some embodiments, track 122 may be secured to a support structure. In some embodiments, the support structure may elevate the spools off of a ground surface. Additionally, a support structure may secure a brace or enclosure, securing portion, or other additional parts of a braiding machine. In the embodiment shown in FIG. 1, braiding machine 100 includes support structure 101.

Figure 2:
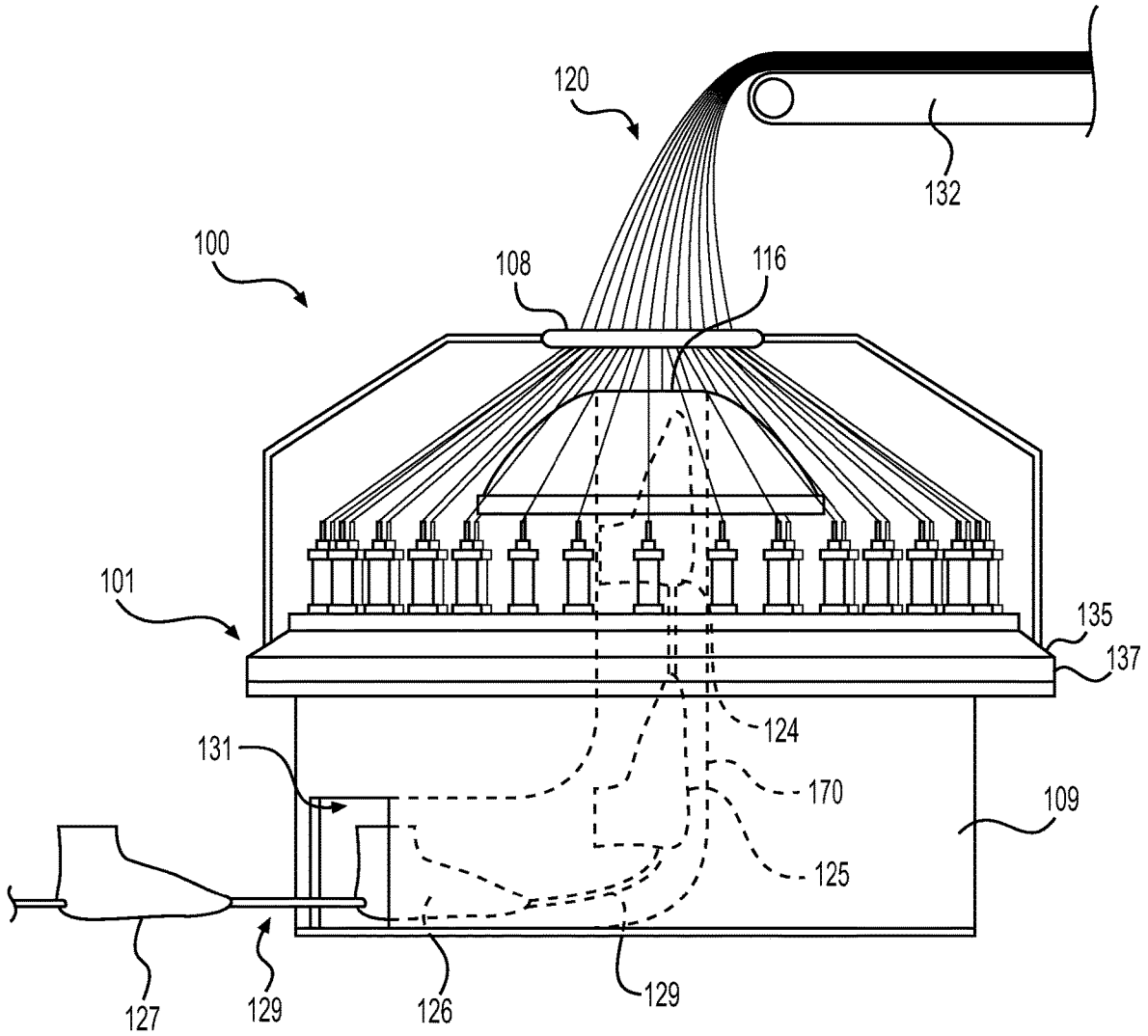
FIG. 2 is a side view of an embodiment of a braiding machine accepting a plurality of lasts.

FIG. 1 illustrates an isometric view of an embodiment of a braiding machine 100. FIG. 2 illustrates a side view of an embodiment of braiding machine 100. In some embodiments, braiding machine 100 may include a support structure 101 and a plurality of spools 102. Support structure 101 may be further comprised of a base portion 109, a top portion 111 and a central fixture 113.

In some embodiments, base portion 109 may comprise one or more walls 121 of material. In the exemplary embodiment of FIGS. 1-2, base portion 109 is comprised of four walls 121 that form an approximately rectangular base for braiding machine 100. However, in other embodiments, base portion 109 could comprise any other number of walls arranged in any other geometry. In this embodiment, base portion 109 acts to support top portion 111 and may, therefore, be formed in a manner so as to support the weight of top portion 111, as well as central fixture 113 and plurality of spools 102, which are attached to top portion 111.

In some embodiments, top portion 111 may comprise a top surface 119, which may further include a central surface portion 133 and a peripheral surface portion 135. In some embodiments, top portion 111 may also include a sidewall surface 137 that is proximate peripheral surface portion 135. In the exemplary embodiment, top portion 111 has an approximately circular geometry; though in other embodiments, top portion 111 could have any other shape. Moreover, in the exemplary embodiment, top portion 111 is seen to have an approximate diameter that is larger than a width of base portion 109, so that top portion 111 extends beyond base portion 109 in one or more horizontal directions.

In some embodiments, central fixture 113 may include an enclosure 112. In some embodiments, enclosure 112 may house or contain knives 110. In other embodiments, enclosure 112 may provide a passageway toward ring 108. In still further embodiments, enclosure 112 may provide a covering for internal parts of braiding machine 100.

In some embodiments, plurality of spools 102 may be evenly spaced around a perimeter portion of braiding machine 100. In other embodiments, plurality of spools 102 may be spaced differently than as depicted in FIG. 1. For example, in some embodiments, about half the number of spools may be included in plurality of spools 102. In such embodiments, the spools of plurality of spools 102 may be spaced in various manners. For example, in some embodiments, plurality of spools 102 may be located along 180 degrees of the perimeter of lace braiding machine. In other embodiments, the spools of plurality of spools 102 may be spaced in other configurations. That is, in some embodiments, each spool may not be located directly adjacent to another spool.

Figure 17:
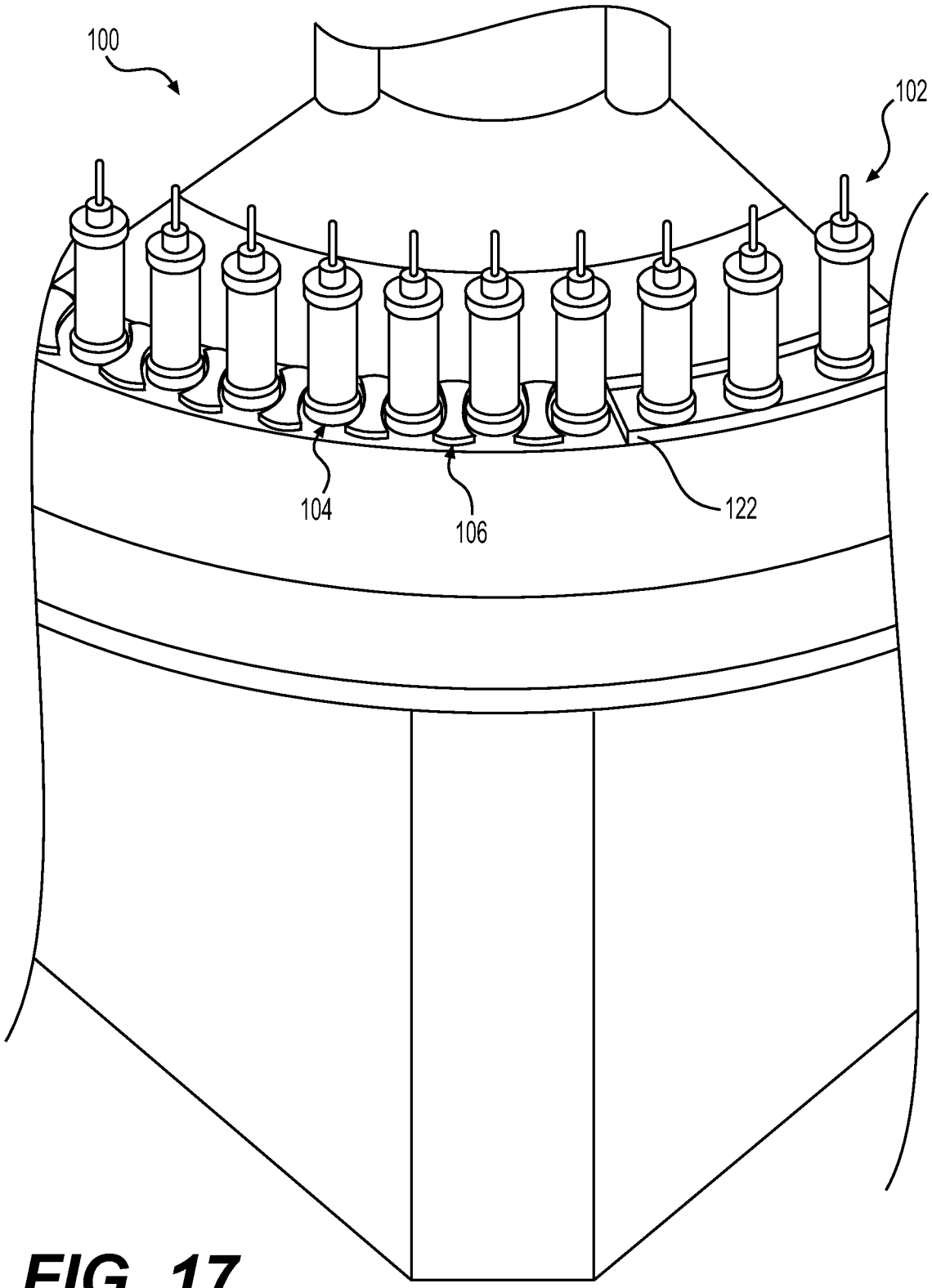
FIG. 17 is a cutaway view of an embodiment of a braiding machine.

In some embodiments, plurality of spools 102 are located within gaps 104 (see FIG. 17) that are located between each of the plurality of rotor metals 106 (see FIG. 17). Plurality of rotor metals 106 may rotate clockwise or counterclockwise, contacting plurality of spools 102. The contact of plurality of rotor metals 106 with plurality of spools 102 may force the plurality of spools 102 to move along track 122. The movement of the plurality of spools 102 may intertwine the threads 120 from each of the plurality of spools 102 with one another. The movement of plurality of spools 102 additionally transfers each of the spools from one gap to another gap of gaps 104.

In some embodiments, the movement of plurality of spools 102 may be programmable. In some embodiments, the movement of plurality of spools 102 may be programmed into a computer system. In other embodiments, the movement of plurality of spools 102 may be programmed using a punch card or other device. The movement of plurality of spools 102 may be preprogrammed to form particular shapes, designs, and thread density of a braided component.

In some embodiments, individual spools may travel completely around the perimeter of braiding machine 100. In some embodiments, each spool of plurality of spools 102 may rotate completely around the perimeter of braiding machine 100. In still further embodiments, some spools of plurality of spools 102 may rotate completely around the perimeter of braiding machine 100 while other spools of plurality of spools 102 may rotate partially around braiding machine 100. By varying the rotation and location of individual spools of plurality of spools 102, various braid configurations may be formed.

In some embodiments, each spool of plurality of spools 102 may not occupy each of gaps 104. In some embodiments, every other gap of gaps 104 may include a spool. In still other embodiments, a different configuration of spools may be placed within each of the gaps 104. As plurality of rotor metals 106 rotate, the location of each of the plurality of spools 102 may change. In this manner, the configuration of the spools and the location of the spools in the various gaps may change throughout the braiding process.

A lace braiding machine may be arranged in various orientations. For example, braiding machine 100 is oriented in a horizontal manner. In a horizontal configuration, plurality of spools 102 are placed in a track that is located in an approximately horizontal plane. The horizontal plane may be formed by an X axis and a Y axis. The X axis and Y axis may be perpendicular to one another. Additionally, a Z axis may be related to height or a vertical direction. The Z axis may be perpendicular to both the Y axis and the X axis. As plurality of spools 102 rotate around braiding machine 100, plurality of spools 102 pass along track 122 that is located in the horizontal plane. In this configuration, each of plurality of spools 102 locally extends in a vertical direction or along the Z axis. That is, each of the spools extends vertically and also perpendicularly to track 122. In other embodiments, a vertical lace braiding machine may be utilized. In a vertical configuration, the track is oriented in a vertical plane.

In some embodiments, a lace braiding machine may include a thread organization member. The thread organization member may assist in organizing the strands or threads such that entanglement of the strands or threads may be reduced. Additionally, the thread organization member may provide a path or direction through which a braided structure is directed. As depicted, braiding machine 100 may include a fell or ring 108 to facilitate the organization of a braided structure. The strands or threads of each spool extend toward ring 108 and through ring 108. As threads 120 extend through ring 108, ring 108 may guide threads 120 such that threads 120 extend in the same general direction.

Additionally, in some embodiments, ring 108 may assist in forming the shape of a braided component. In some embodiments, a smaller ring may assist in forming a braided component that encompasses a smaller volume. In other embodiments, a larger ring may be utilized to form a braided component that encompasses a larger volume.

In some embodiments, ring 108 may be located at the braiding point. The braiding point is defined as the point or area where threads 120 consolidate to form a braid structure. As plurality of spools 102 pass around braiding machine 100, thread from each spool of plurality of spools 102 may extend toward and through ring 108. Adjacent or near ring 108, the distance between thread from different spools diminishes. As the distance between threads 120 is reduced, threads 120 from different spools intermesh or braid with one another in a tighter fashion. The braiding point refers to an area where the desired tightness of threads 120 has been achieved on the braiding machine.

In some embodiments, a tensioner may assist in providing the strands with an appropriate amount of force to form a tightly braided structure. In other embodiments, knives 110 may extend from enclosure 112 to "beat up" the strands and threads so that additional braiding may occur. Additionally, knives 110 may tighten the strands of the braided structure. Knives 110 may extend radially upward toward and against threads 120 of the braided structure as threads 120 are braided together. Knives 110 may press and pat the threads upward toward ring 108 such that the threads are compacted or pressed together. In some embodiments, knives 110 may prevent the strands of the braided structure from unraveling by assisting in forming a tightly braided structure. Additionally, in some embodiments, knives 110 may provide a tight and uniform braided structure by pressing threads 120 toward ring 108 and toward one another. In other Figures in this Detailed Description, knives 110 may not be depicted for ease of viewing.

In some embodiments, ring 108 may be secured to braiding machine 100. In some embodiments, ring 108 may be secured by brace 123. In other embodiments, ring 108 may be secured by other mechanisms.

In some embodiments, braiding machine 100 may include a path, passageway, channel, or tube that extends from enclosure 112 to a base portion of braiding machine 100. In some embodiments, a first opening 116 to passageway 170 may be located at an upper portion of enclosure 112. In some embodiments, the shape of first opening 116 may be similar to the shape of ring 108. In other embodiments, the shape of first opening 116 may be a different shape than the shape of ring 108.

In some embodiments, first opening 116 may be aligned with ring 108. For example, in some embodiments, the central point of ring 108 may be aligned with first opening 116 along vertical axis 118. In other embodiments, first opening 116 may be offset from ring 108.

In some embodiments, first opening 116 may be located above track 122. In other embodiments, first opening 116 may be located vertically above plurality of spools 102. That is, in some embodiments, the plane in which first opening 116 is located may be vertically above the plane in which plurality of spools 102 are located. In other embodiments, first opening 116 may be located in the same plane as plurality of spools 102 or track 122. In still further embodiments, first opening 116 may be located below track 122.

In still further embodiments, a braiding machine may be arranged in a different configuration. In some embodiments, a braiding machine may be configured without a first opening through an enclosure. For example, in embodiments in which the braiding machine is oriented in a radial configuration, the braiding machine may not include an enclosure or other structures.

In some embodiments, the shape of the openings within braiding machine 100 may be varied. In some embodiments, the shape of the first opening may be the same as the shape of the second opening. In other embodiments, the shape of the first opening may be different than the second opening. By varying the shape of the openings, differently shaped objects may be passed through the openings. Additionally, different shapes may be used to fit within the layout or configuration of braiding machine 100. For example, enclosure 112 and first opening 116 may have a similar circular shape. This similar shape may allow for knives 110 to be evenly distributed around enclosure 112 and may allow for each of the knives of knives 110 to extend toward first opening 116 in the same or similar manner as each other. As depicted in FIG. 1, first opening 116 has an approximately circular shape, while second opening 131 has an approximately rectangular shape.

In some embodiments, first opening 116 and second opening 131 may be in fluid communication with each other. That is, in some embodiments, a channel or passageway may extend between first opening 116 and second opening 131. In some embodiments, the cross-section of the passageway may be circular. In other embodiments, the cross-section of the passageway may be rectangular. In still further embodiments, the cross-section of the passageway may be a different shape. In other embodiments, the cross-section of the passageway may be regularly shaped or irregularly shaped.

In some embodiments, the shape of the objects may be varied. In some embodiments, the shape of the objects passing from second opening 131 to first opening 116 may be in the shape of a foot or a last. In other embodiments, the objects may be in the shape of an arm or leg. In still further embodiments, the shape of the object may be a different shape. As shown in FIG. 2, multiple foot-shaped objects or forming lasts are depicted. For example, in FIG. 2, first forming last 124, second forming last 125, third forming last 126, and fourth forming last 127 are depicted. Each of the forming lasts may be in the shape of a foot or footwear last.

Figure 7:
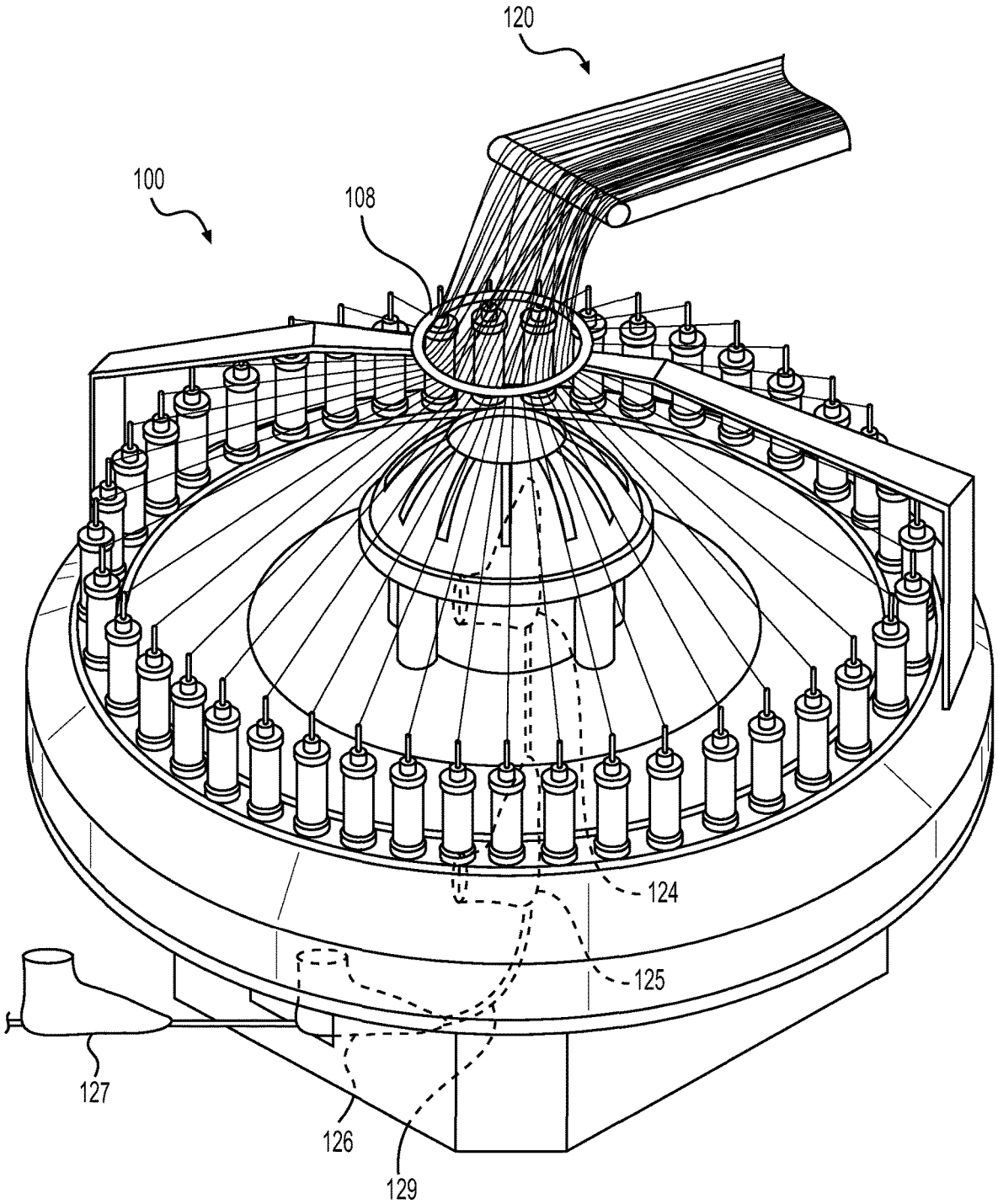
FIG. 7 is an isometric view of an embodiment of a braiding machine overbraiding a last.

In some embodiments, an object may be passed from second opening 131 to first opening 116. In some embodiments, the object may pass through passageway 170 that extends from first opening 116 to second opening 131. Passageway 170, as depicted in FIG. 2, is not shown in FIGS. 7 and 8 for ease of viewing. As shown in FIG. 2, fourth forming last 127 may be located outside of passageway 170 between second opening 131 and first opening 116. Additionally, third forming last 126 may extend partially through second opening 131. Further, first forming last 124 and second forming last 125 may be located within passageway 170 between second opening 131 and first opening 116. That is, first forming last 124 and second forming last 125 may not be visible from a side view of braiding machine 100. An isometric view of the depiction shown in FIG. 2 is shown in FIG. 7.

In some embodiments, second opening 131 may be located a distance away from first opening 116. In some embodiments, second opening 131 may be located in the base portion of braiding machine 100. In other embodiments, second opening 131 may be located in different areas. In still other embodiments, second opening 131 may not be present. For example, as discussed previously, a lace braiding machine may have a different configuration than braiding machine 100. In such embodiments, there may not be a solid structure between plurality of spools 102. For example, in some embodiments, a lace braiding machine may be formed in a radial configuration. In such embodiments, there may not be a first and second opening.

By varying the location of first opening 116, the distance that a last may travel during the braiding process may be varied. In embodiments that include a first opening that is further away from the braiding point, a last or other object that is passed through passageway 170 may be exposed for a longer distance without being braided upon. In some embodiments, additional processes may be performed upon a last prior to being overbraided by threads. In other embodiments, a first opening may be located closer to the braiding point. In such embodiments, a last may not be exposed for a large distance prior to being overbraided. In such a configuration, misalignment of lasts through the braiding point may be reduced. Additionally, by locating the first opening close to the braiding point, additional guides for aligning the lasts may not be necessary.

In some embodiments, multiple objects may be passed from second opening 131 to first opening 116. In some embodiments, multiple objects may be connected to one another. In some embodiments, each object may be connected to an adjacent object by a connection mechanism. In some embodiments, the connection mechanism may be a rope, strand, chain, rod, or other connection mechanism.

Referring to FIG. 2, each of the forming lasts may be connected to each other by connection mechanism 129. In some embodiments, each of the connection mechanisms may be the same length. In other embodiments, the length of the connection mechanisms may be varied. By changing the length of the connection mechanisms, the amount of waste formed during manufacturing of an article of footwear may be changed.

In some embodiments, connection mechanism 129 may extend from a forefoot region of a first object to a heel region of a second object. As shown in FIG. 2, connection mechanism 129 extends from a forefoot region of fourth forming last 127 to a heel region of third forming last 126. In other embodiments, different orientations of forming lasts may be utilized. For example, in some embodiments, connection mechanism 129 may extend between adjacent heel regions of adjacent forming lasts.

In some embodiments, the connection mechanism may be a non-rigid structure. In this Detailed Description, a non-rigid structure includes structures that are able to bend or distort without permanently deforming or substantially diminishing the strength of the structure. In some embodiments, as the forming lasts pass from second opening 131 to first opening 116, the passageway that connects first opening 116 and second opening 131 may twist or turn. In such embodiments, a connection mechanism that is able to bend or turn may be used so that the objects may continuously pass from second opening 131 to first opening 116.

In some embodiments, a non-rigid structure may be formed by varying the geometry of the connection mechanism or the material from which the connection mechanism is formed. For example, a non-rigid structure may be formed by using links within a chain. In other embodiments, a non-rigid structure may be formed by using a pliable rubber material or other non-rigid material.

In some embodiments, the shape and size of the forming lasts may be varied. In some embodiments, the forming lasts may be the same size or shape. In other embodiments, differently sized forming lasts may be used. In still further embodiments, an object the shape of a last may be connected to an object that is a different shape; for example, a forming last may be connected to an object that is the shape of an arm or a leg. By varying the shape and size of the object, a differently shaped braided component may be formed.

Figure 3:
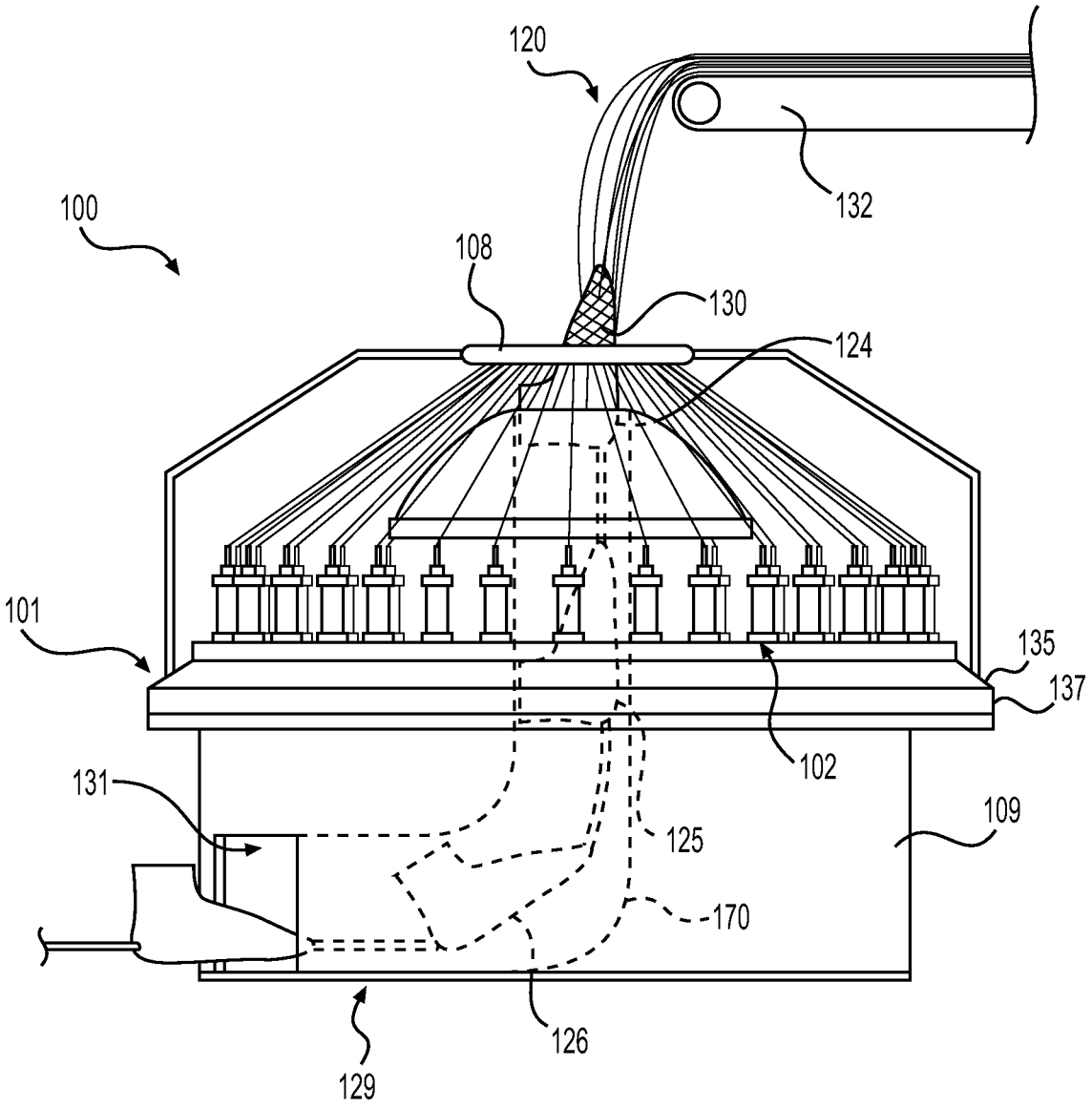
FIG. 3 is a side view of an embodiment of a braiding machine overbraiding a portion of a last.
Figure 4:
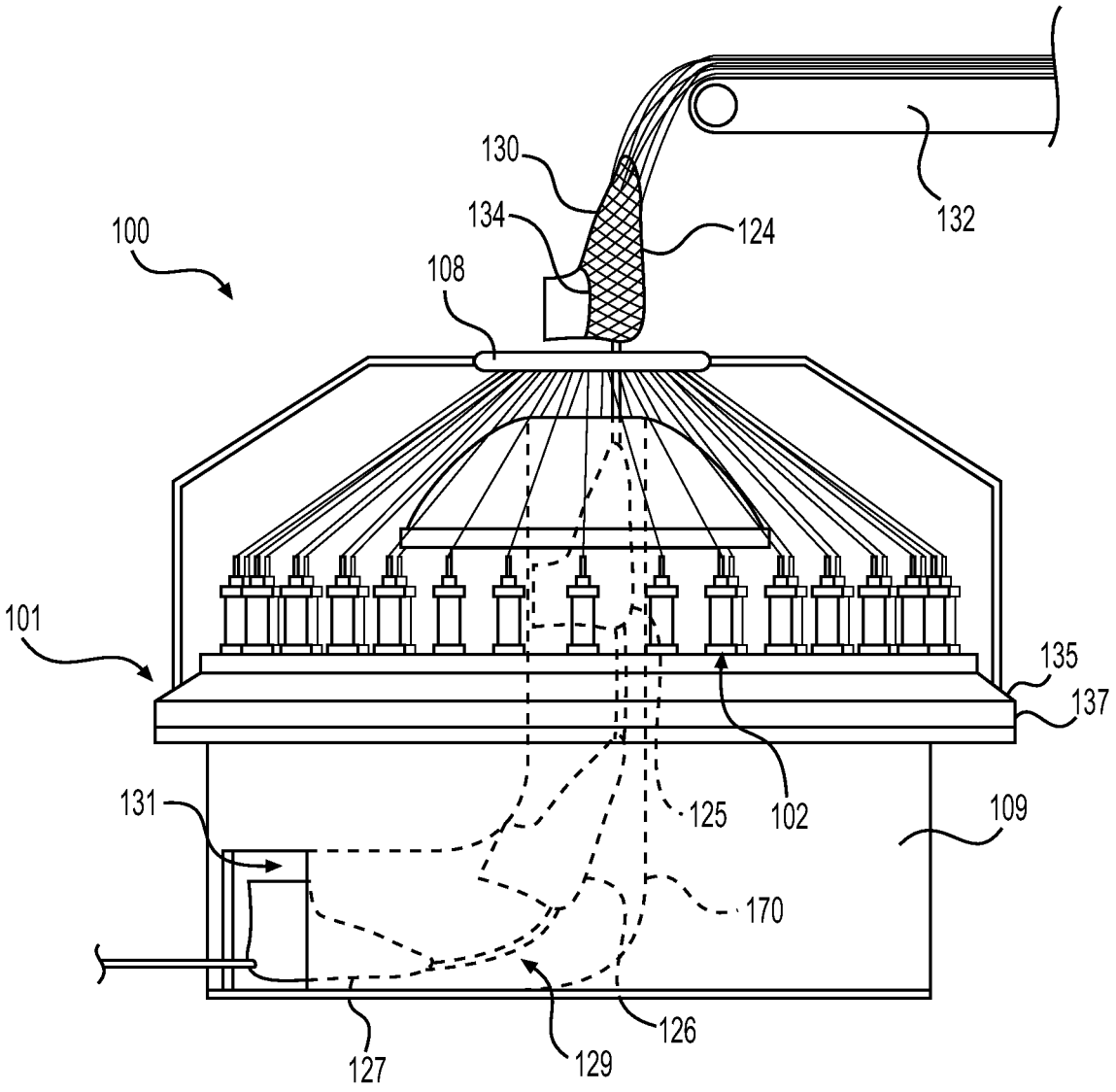
FIG. 4 is a side view of an embodiment of a braiding machine overbraiding a last.
Figure 8:
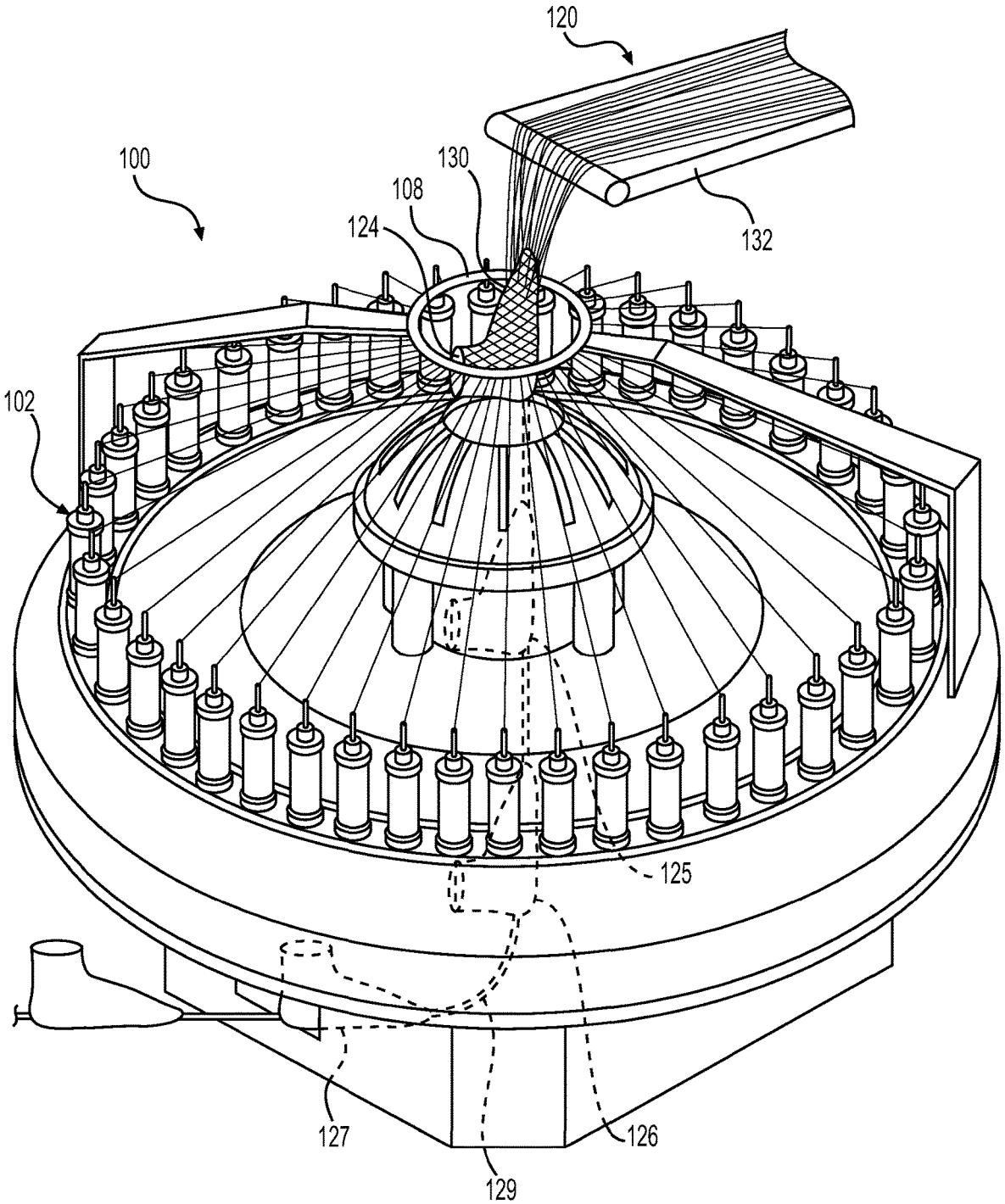
FIG. 8 is an isometric view of an embodiment of a braiding machine overbraiding a last.

In some embodiments, the forming lasts may pass through braiding machine 100. As depicted in FIG. 3, the forming lasts begin to move through braiding machine 100. Referring specifically to first forming last 124, a portion of first forming last 124 extends out of first opening 116. Additionally, a portion of first forming last 124 extends through the braiding point located at ring 108. As shown in FIGS. 2 through 4, first forming last 124 passes from one side of ring 108 to the other side of ring 108. In this embodiment, as first forming last 124 passes from one side of ring 108 to the other side of ring 108, first forming last 124 passes through the braiding point of braiding machine 100. As plurality of spools 102 rotate around braiding machine 100, threads 120 overbraid first forming last 124 as first forming last 124 passes through the braiding point. Threads 120 may interact with one another to form braided component 130 that extends around first forming last 124. An alternate isometric view of the depiction of FIG. 3 is shown in FIG. 8.

In some embodiments, as the spools of braiding machine 100 travel around track 122, the forming lasts may advance through braiding machine 100. In some embodiments, a tensioner, such as a carrier, may tension or pull threads 120 as threads 120 extend through ring 108. The tension upon threads 120 may pull the forming lasts through braiding machine 100 as the forming lasts are overbraided. In other embodiments, a connection mechanism or similar mechanism may be secured to first forming last 124. The connection mechanism may extend through ring 108 and toward a carrier or other tension device. In some embodiments, the connection mechanism may be tensioned such that the forming lasts are pulled through braiding machine 100 and the braiding point.

Figure 5:
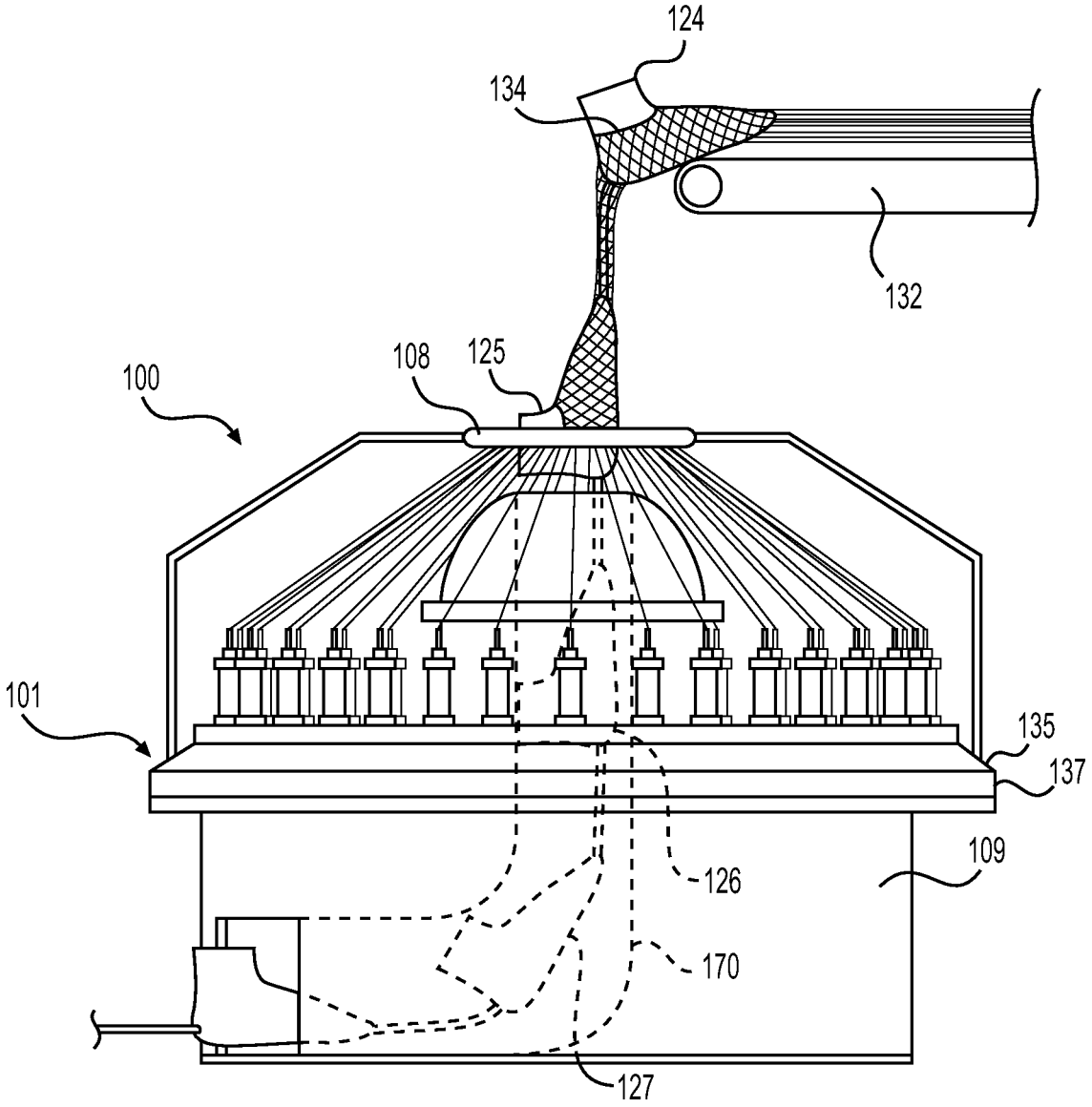
FIG. 5 is a side view of an embodiment of a braiding machine overbraiding a last.
Figure 6:
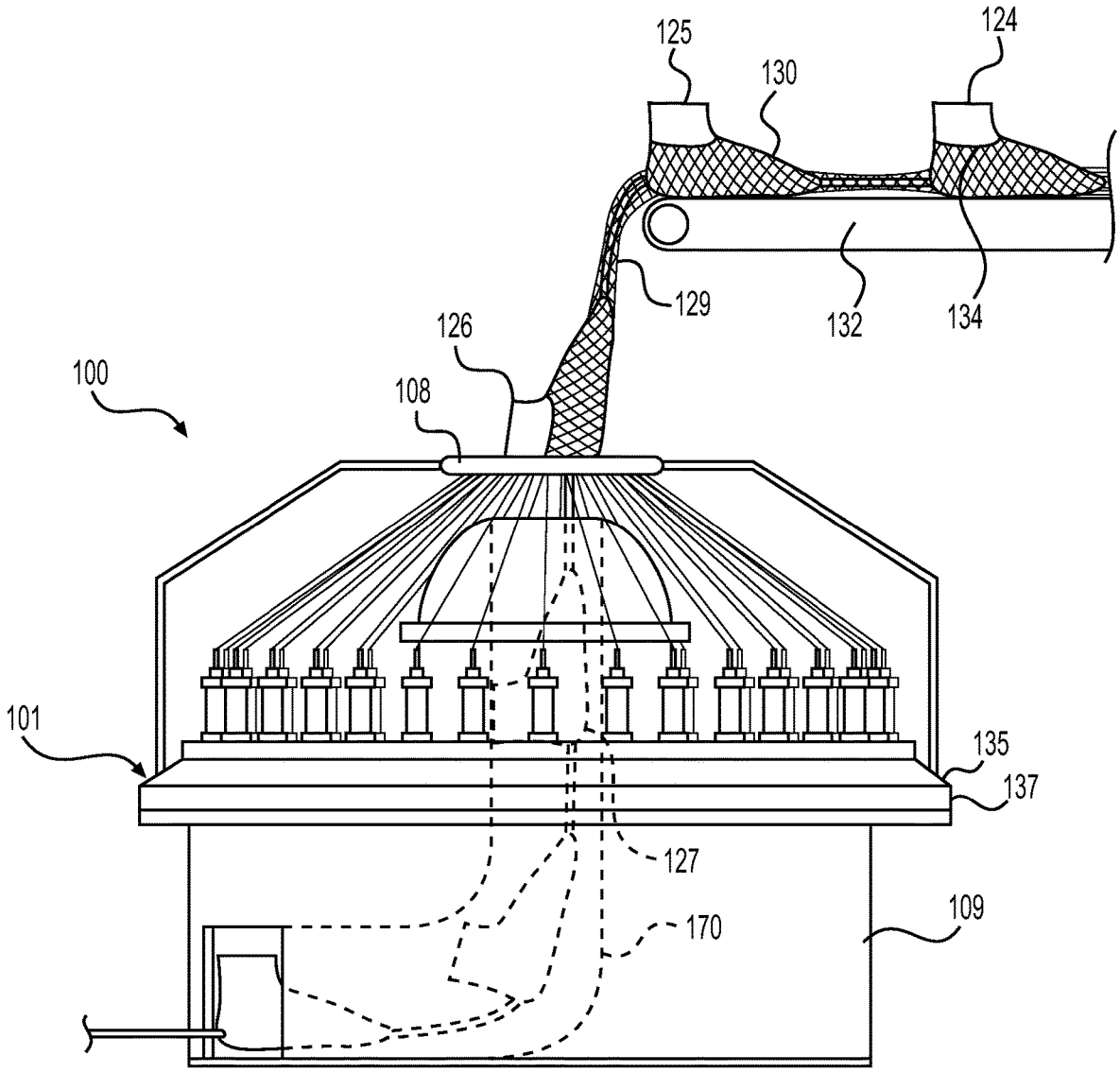
FIG. 6 is a side view of an embodiment of a braiding machine overbraiding a last.

Referring to FIGS. 4 through 6, forming lasts are shown passing through braiding machine 100. As depicted, the forming lasts may pass from one side of ring 108 through ring 108 to the other side of ring 108 one after another in a continuous manner. As each of the forming lasts pass through the braiding point of braiding machine 100, threads 120 may overbraid around the forming lasts. Additionally, connection mechanism 129 between each of the forming lasts may be overbraided as well. As threads 120 extend around the forming lasts, a braided component that conforms to the shape of the forming lasts may be formed.

In some embodiments, forming lasts may be pulled along a roller or conveyor belt. As shown in FIGS. 2-6, conveyor 132 may be utilized to organize the forming lasts. As each forming last is overbraided, the forming last may be pulled toward conveyor 132 and advanced for additional processing. As shown in FIG. 6, first forming last 124 and second forming last 125 are both advanced along conveyor 132. In some embodiments, conveyor 132 may assist in altering the direction of tension that is directed along threads 120 and braided component 130. As shown, conveyor 132 may assist in aligning tension along a vertical direction between conveyor 132 and ring 108. As threads 120 and forming lasts extend across conveyor 132, the tension may extend in a horizontal direction. In this configuration, a horizontal tensile force may, therefore, be transitioned into a vertical tensile force by the use of conveyor 132. By varying the location of conveyor 132, the direction of a tensile force may be altered. For example, by locating a roller off center from a ring, the direction of the tensile force may not be vertical. In such embodiments, a forming last may pass through the ring at an angle. This may cause different designs to be formed along the forming last as the forming last would pass through the braiding point at an angle.

As shown in FIGS. 4-6, in some embodiments, an opening may be formed along the side of the forming lasts. For example, an opening 134 may be formed around an ankle portion of first forming last 124. In some embodiments, opening 134 may be formed during the braiding process.

Figure 9:
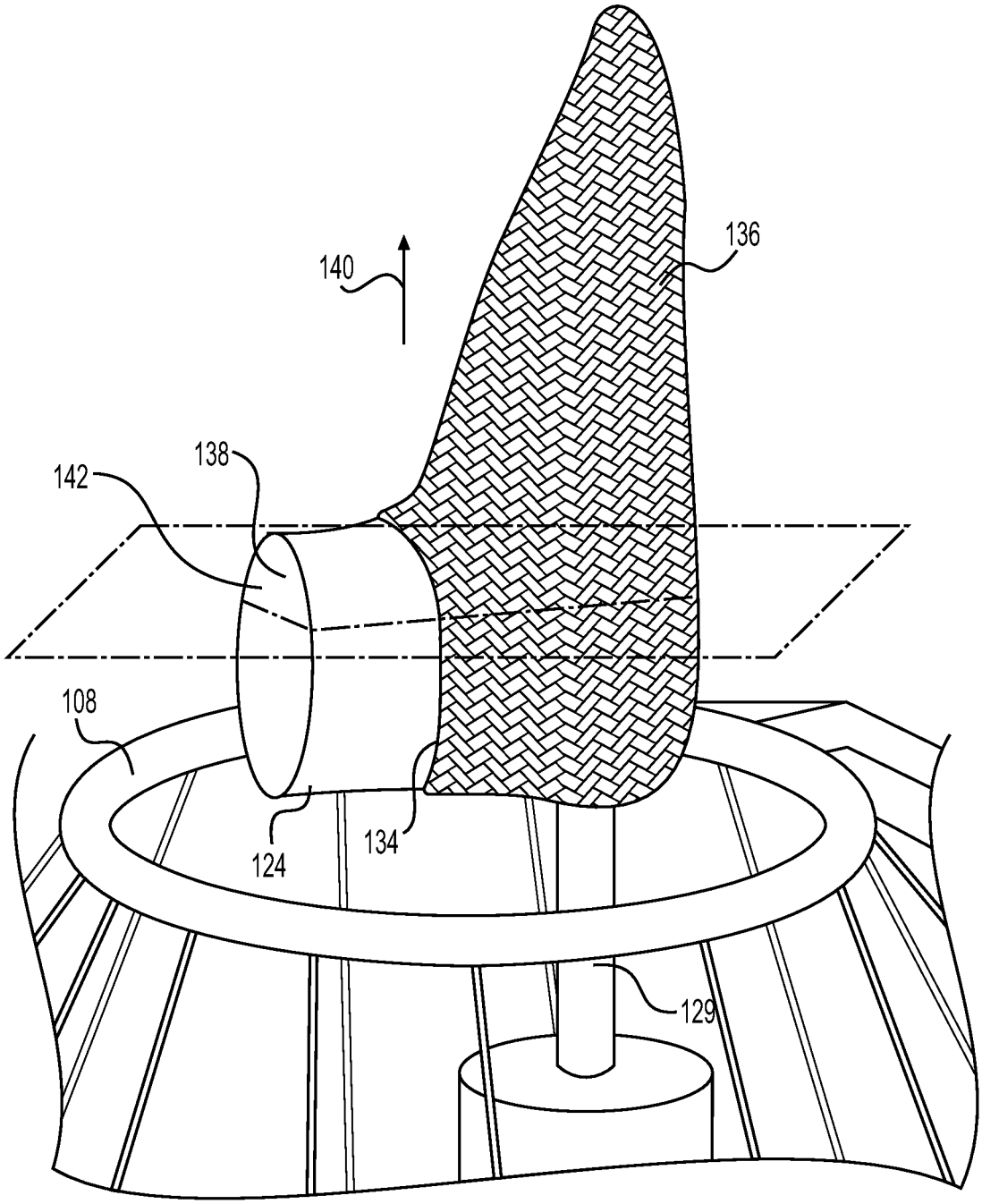
FIG. 9 is a schematic view of an embodiment of a braided portion formed around a forming last.

Referring to FIG. 9, a braided portion is formed along and around a forming last. As shown, braided portion 136 extends along first forming last 124. Braided portion 136 may be a portion of braided component 130. In some embodiments, braided portion 136 may be cut or separated from the braided component after manufacturing. Braided portion 136 may include an opening that is associated with the location of ankle portion 138. In some embodiments, an ankle opening may be formed within braided portion 136 that generally surrounds or encompasses the shape of ankle portion 138. In other embodiments, an ankle opening may be formed that is larger than ankle portion 138. In still further embodiments, a braided portion may be formed that does not include an ankle opening. Rather, a braided portion may extend around the ankle portion such that no opening is formed.

Figure 10:
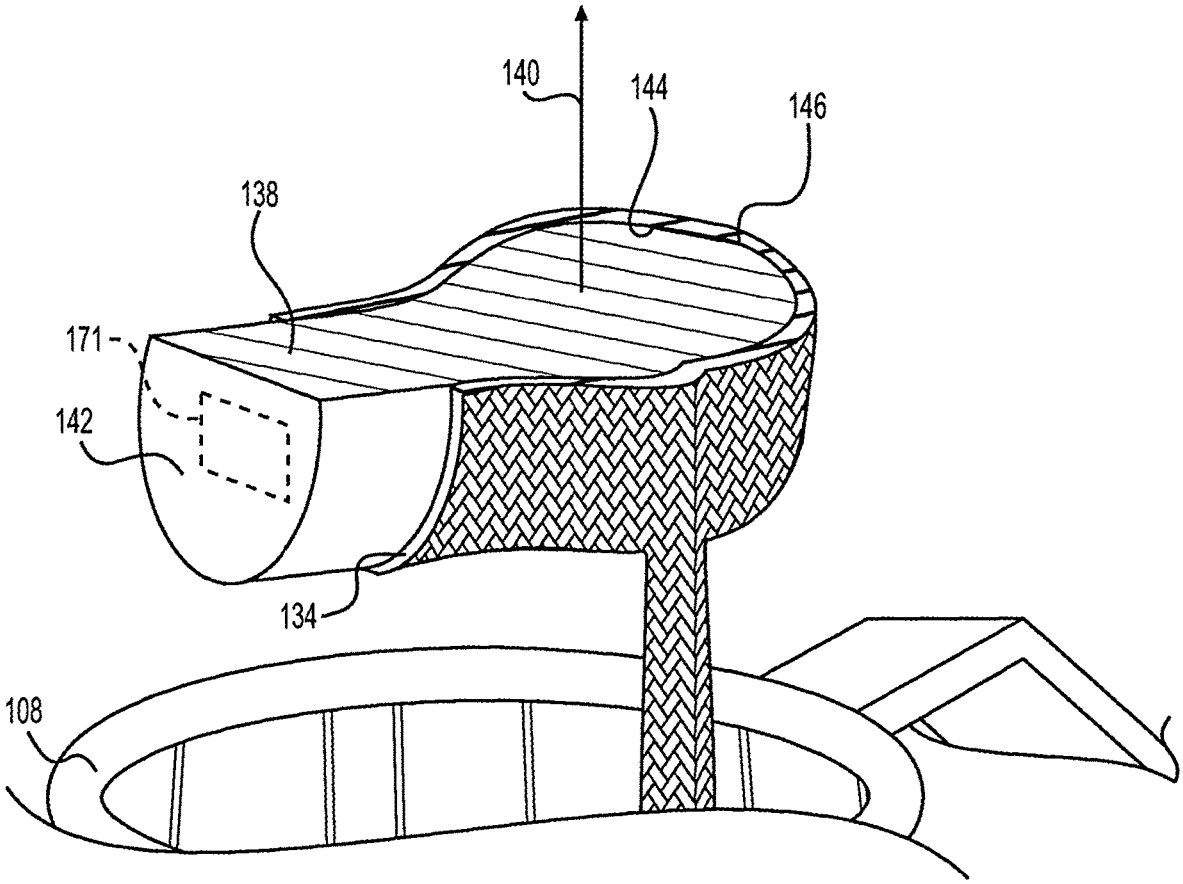
FIG. 10 is an isometric cross-sectional view of the forming last and the braided portion.

In some embodiments, the forming last may not be overbraided completely around the forming last. In some embodiments, a portion of the forming last may not be overbraided. In some embodiments, an opening may be formed within a braided component that is along or parallel to the braiding direction. Additionally, the forming last may not be covered or overbraided in a plane or surface that is located along ankle portion surface 142. In other embodiments, the forming last may be completely overbraided. Additionally, the ankle portion of a braided portion may be cut out or removed in embodiments that overbraid the ankle portion. As shown in FIGS. 9 and 10, the opening of braided portion 136 around ankle portion 138 is parallel to braiding direction 140. That is, the opening may be formed in a vertical plane along braided portion 136. In this Detailed Description, a vertical plane incorporates the vertical axis. Braiding direction, as used in this Detailed Description, is used to describe the direction in which the braided portion extends away from the braiding machine. In FIG. 9, for example, braiding direction 140 extends vertically away from braiding machine 100.

Generally, braiding machines may form openings that are perpendicular to the braiding direction on either end of a braided structure. That is, the openings generally extend in an area occupied by ring 108. In this embodiment, the openings are located in the horizontal plane, or the plane in which ring 108 is located. Additionally, radial braiding machines or non-jacquard machines may not form additional openings that are parallel to the braiding direction. Lace braiding machines, however, may be programmed to form openings parallel to the braiding direction. For example, a lace braiding machine may form an opening in a vertical plane or a plane that is perpendicular to the plane in which ring 108 is located, within a braided portion.

As shown, braided portion 136 may be formed vertically and parallel with braiding direction 140. As braiding machine 100 forms a braided portion, the braided portion extends vertically. The initial braided portion may form an opening in the horizontal plane, such as the opening at the end of a tube. Upon completion of a braided structure, another opening may be formed in the horizontal plane. These openings are formed perpendicular to the braiding direction and are part of the manufacturing process. Additionally, the openings are parallel to the horizontal plane in which ring 108 is located. In some embodiments, these openings may correspond in shape and location to connection mechanisms that extend between the forming lasts.

In some embodiments, braided portion 136 may include an opening parallel with the braiding direction or within a vertical plane. In some embodiments, the opening may correspond to an ankle opening. In other embodiments, an opening may be located along other areas of an article. An opening is used to define a space within the braided structure that is formed as a deliberate altering of the braided structure. For example, the spaces between strands of a radially braided structure may not be considered openings for purposes of this Detailed Description. As shown in FIG. 9, opening 134 may be formed parallel to the braiding direction.

Opening 134 may be formed of various shapes and sizes. In some embodiments, opening 134 may be largely circular. In other embodiments, opening 134 may be irregularly shaped. Additionally, in some embodiments, opening 134 may correspond to the shape of ankle portion 138. That is, in some embodiments, braided portion 136 may extend to the end of ankle portion 138. In this embodiment, however, braided portion 136 may not cover ankle portion surface 142.

Referring to FIG. 10, a cross-sectional view of braided portion 136 and first forming last 124 is depicted. As shown, braided portion 136 surrounds the outer periphery of first forming last 124. Braided portion 136, however, does not completely envelop first forming last 124. Rather, braided portion 136 conforms around the outer periphery of first forming last 124. Additionally, ankle opening 134 is formed along a vertical plane, for example, vertical plane 171, in the braiding direction of braided portion 136. Opening 134, therefore, does not cover ankle portion surface 142, which is parallel to the braiding direction and located along vertical plane 171.

In some embodiments, the interior surface of a braided portion may correspond to the surface of the forming mandrel. As depicted, interior surface 144 largely corresponds to forming last surface 146. As threads 120 extend through ring 108, threads 120 interact with first forming last 124. First forming last 124 interrupts the path of threads 120 such that threads 120 are overbraided around first forming last 124. In this embodiment, as first forming last 124 passes through the braiding point, a braided component may tightly conform to the shape of first forming last 124.

Figure 11:
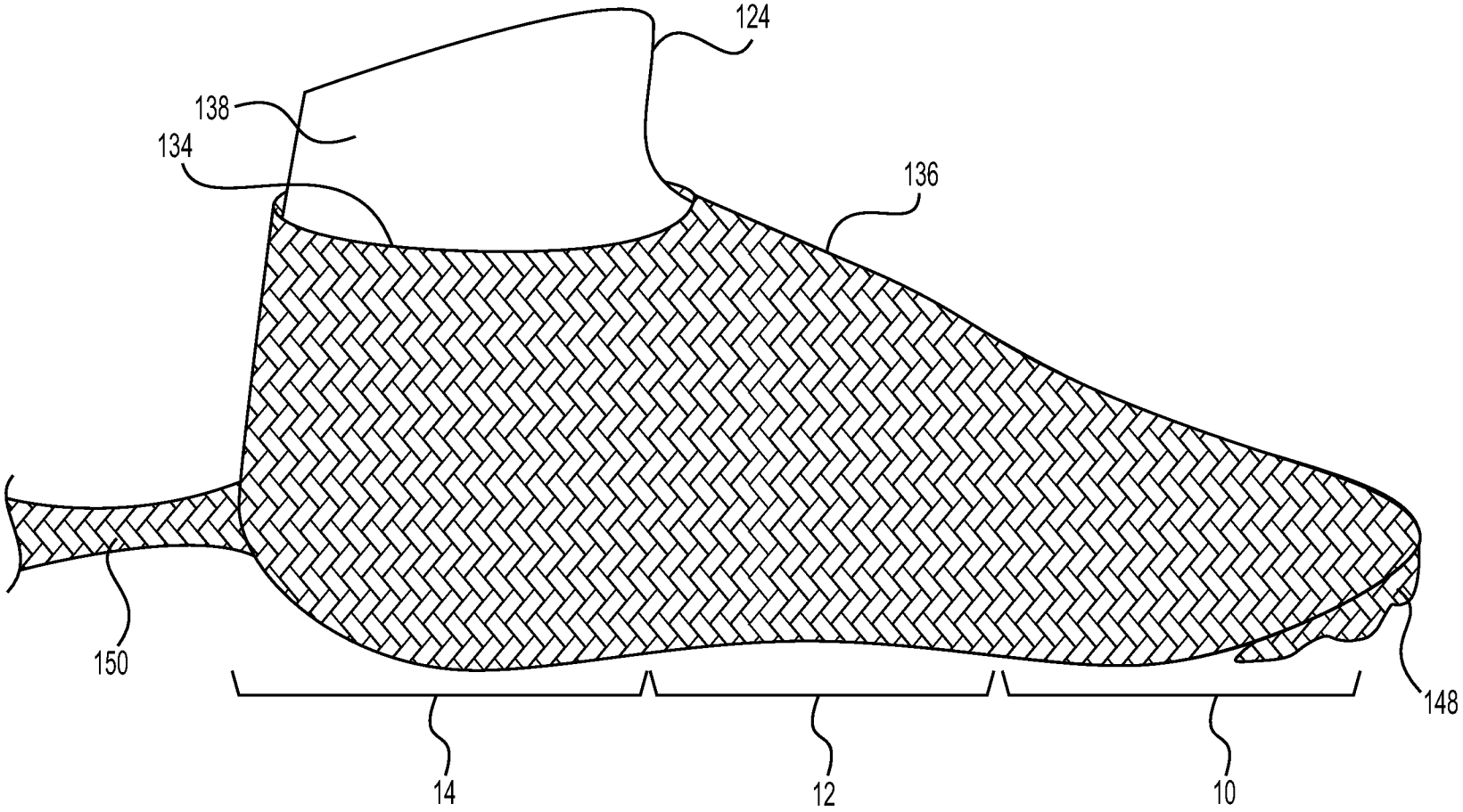
FIG. 11 is a schematic view of a braided portion around a forming last.

Referring to FIG. 11, first forming last 124 and braided portion 136 are shown in isolation from other braided portions and forming lasts. Braided portion 136 is depicted being formed into a component of an article of footwear with the assistance of first forming last 124.

In some embodiments, parameters of the braiding process may be varied to form braided portions with various dimensions or different braid densities. In some embodiments, a forming last may be advanced through the braiding point at different velocities. For example, in some embodiments, first forming last 124 may advance at a high rate of speed through the braiding point. In other embodiments, first forming last 124 may advance by a slow rate of speed. That is, braided portion 136 may be formed at different rates of speeds. By changing the vertical advancement of first forming last 124 through the braiding point, the density of the braided structure may vary. A lower density structure may allow for a larger braided portion or less coverage around the forming last. A lower density structure may be formed when a forming last is passed through the braiding point at a higher rate of speed. A higher density structure may be formed when a forming last is passed through the braiding point at a lower rate of speed. Additionally, the plurality of spools may rotate at various speeds. By varying the speed of rotation of the plurality of spools, the density of the braided structure may vary. For example, when advancing a forming last through the braiding point at a constant speed, the speed at which the plurality of spools rotate may adjust the density of the braided structure. By increasing the speed of rotation of the plurality of spools, a higher density braided structure may be formed. By decreasing the speed of rotation of the plurality of spools, a lower density braided structure may be formed. By varying the speed of advancement of first forming last 124 and the speed that plurality of spools 102 rotate, differently sized braided portions may be formed as well as braided portions of different densities.

In some embodiments, braided portion 136 may include opening 134. Although shown extending around ankle portion 138 (see FIG. 9), in some embodiments, opening 134 may extend toward an instep area. Further, opening 134 may extend from heel region 14 to midfoot region 12. In still other embodiments, opening 134 may extend into forefoot region 10.

Figure 24:
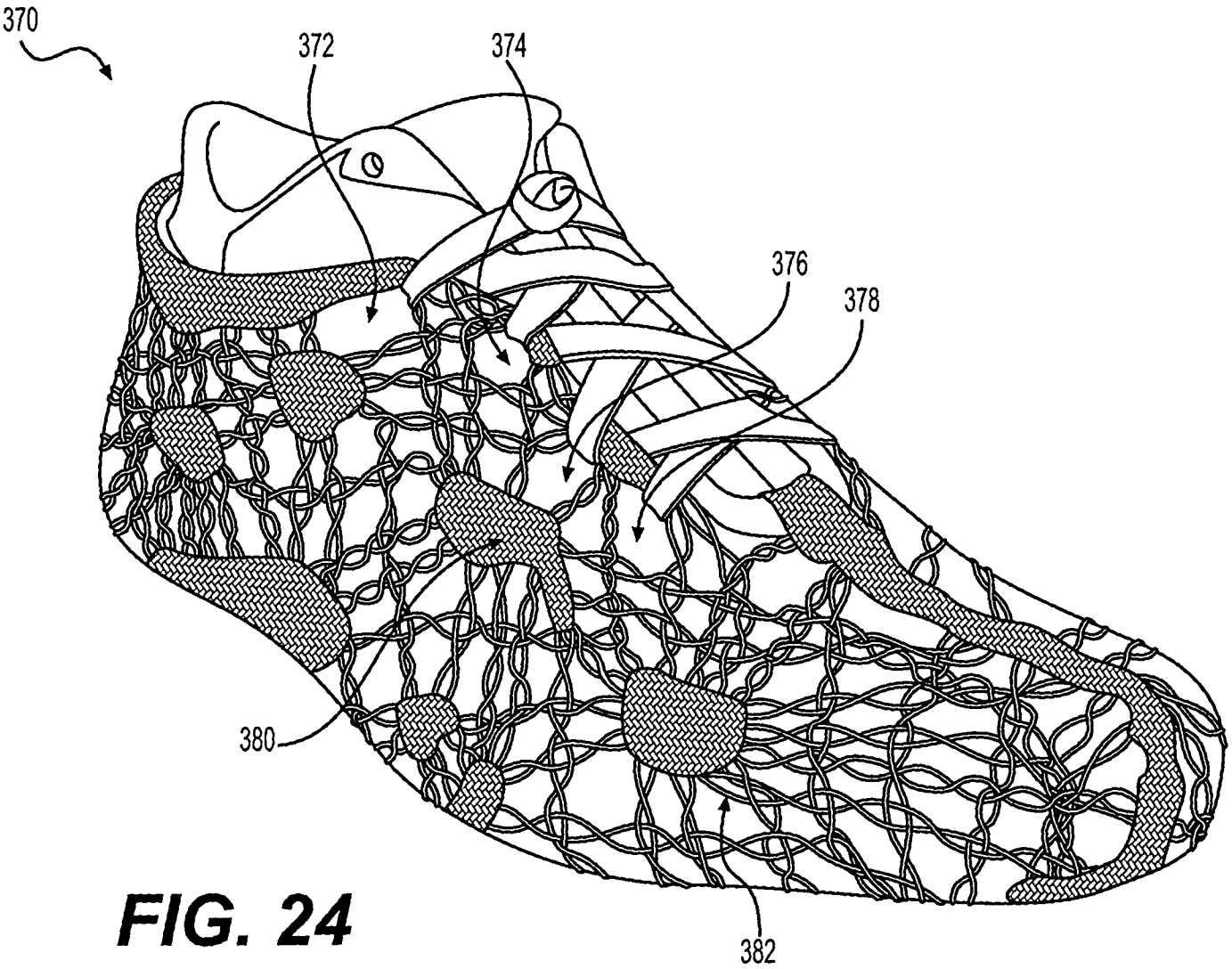
FIG. 24 is schematic view of an embodiment of an article of footwear formed using the braiding machine.

In some embodiments, the instep area may include lace apertures (see FIG. 24). In some embodiments, lace apertures may be formed during the braiding process. That is, in some embodiments, the lace apertures may be formed integrally with braided portion 136. Therefore, there may not be a need to stitch or form lace apertures after braided portion 136 is formed. By integrally forming lace apertures during manufacturing, the manufacturing process may be simplified while reducing the amount of time necessary to form an article of footwear.

In some embodiments, a free portion may extend from forefoot region 10 of braided portion 136. In some embodiments, a free portion 148 of braided portion 136 may be cut or otherwise removed from braided portion 136. Additionally, in other embodiments, free portion 148 may be wrapped below braided portion 136. Additionally, in some embodiments, a free portion 150 may extend from heel region 14. Free portion 150 may additionally be cut or otherwise removed from braided portion 136. Further, free portion 150 may be wrapped below braided portion 136. Free portion 150 may be formed during the braiding process as a braided structure is formed over a connection mechanism. Likewise, free portion 148 may be formed in the same or similar manner.

Figure 12:
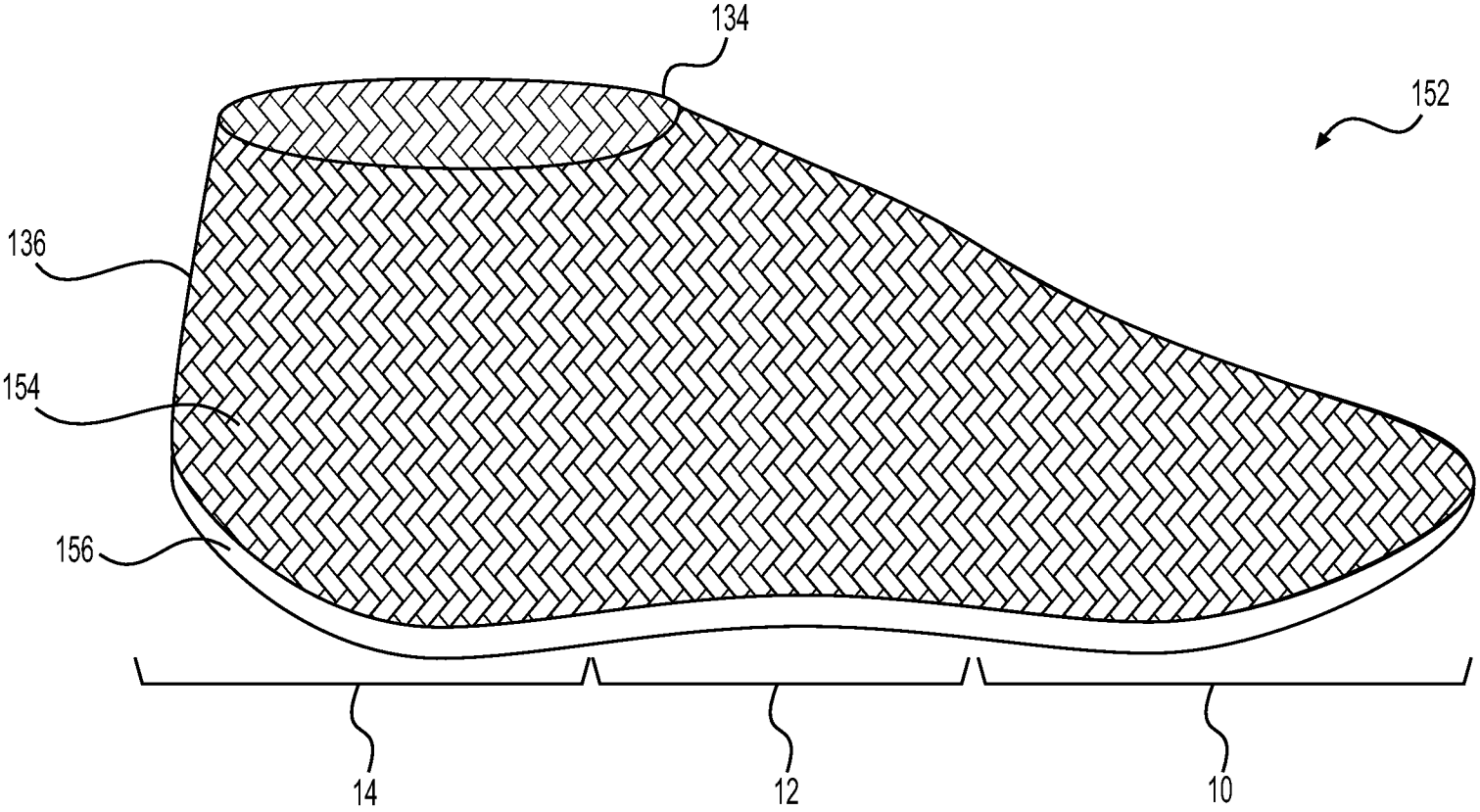
FIG. 12 is a schematic view of an embodiment of an article of footwear incorporating a braided portion.

Referring to FIG. 12, article of footwear or simply article 152 is depicted. As shown, braided portion 136 is incorporated into article 152 and forms a portion of upper 154. Additionally, in some embodiments, sole structure 156 is included and secured to upper 154. In this manner, article 152 is formed. By using a braiding machine, the number of elements used to form an article of footwear may be reduced as compared to conventional methods. Additionally, by utilizing a braiding machine, the amount of waste formed during the manufacturing of an article of footwear may be reduced as compared to other conventional techniques.

In some embodiments, opening 134 may be various sizes. Although depicted as being located largely in an ankle portion in heel region 14, opening 134 may extend toward forefoot region 10. Additionally, opening 134 may extend from an ankle portion toward sole structure 156. That is, opening 134 may be varied in the vertical direction. For example, opening 134 may extend from an upper area adjacent the ankle portion of article 152 toward sole structure 156.

While the embodiments of the figures depict articles having low collars (e.g., low-top configurations), other embodiments could have other configurations. In particular, the methods and systems described herein may be utilized to make a variety of different article configurations, including articles with higher cuff or ankle portions. For example, in another embodiment, the systems and methods discussed herein can be used to form a braided upper with a cuff that extends up a wearer's leg (i.e., above the ankle). In another embodiment, the systems and methods discussed herein can be used to form a braided upper with a cuff that extends to the knee. In still another embodiment, the systems and methods discussed herein can be used to form a braided upper with a cuff that extends above the knee. Thus, such provisions may allow for the manufacturing of boots comprised of braided structures. In some cases, articles with long cuffs could be formed by using lasts with long cuff portions (or leg portions) with a braiding machine (e.g., by using a boot last). In such cases, the last could be rotated as it is moved relative to a braiding point so that a generally round and narrow cross-section of the last is always presented at the braiding point.

Figure 13:
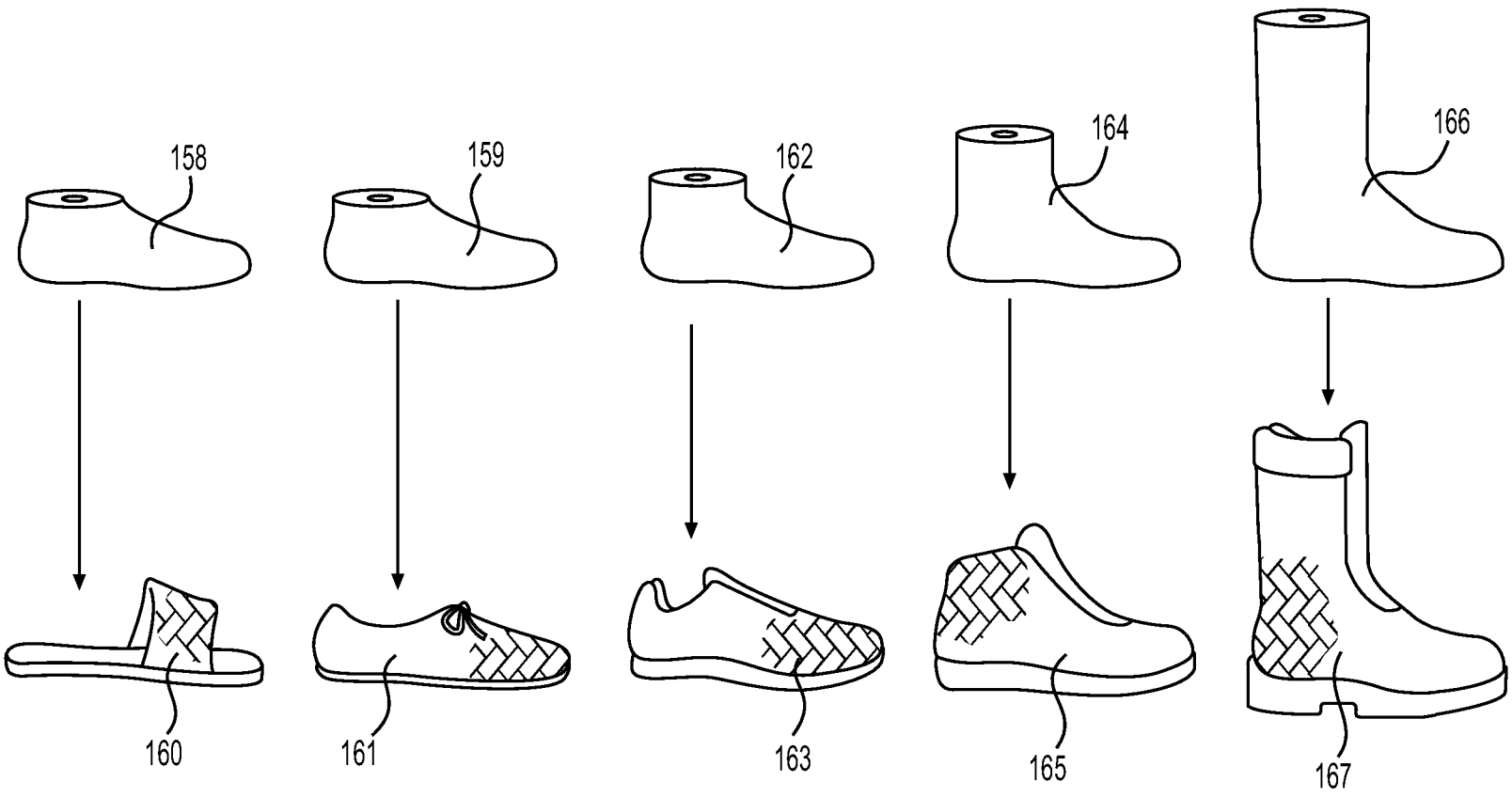
FIG. 13 is a schematic view of multiple lasts used to form various articles.

Referring to FIG. 13, various forming lasts are depicted. Additionally, an article that incorporates a braided portion is shown below each forming last that depicts an example of the type of article that may be formed by using a particularly shaped and sized forming last.

In some embodiments, forming lasts may be used to form different types of articles of footwear. In some embodiments, the same forming last may be used to form a different type of footwear. For example, forming last 158 and forming last 159 may be formed in approximately the same shape. Article 160 may be formed by using forming last 158 in conjunction with braiding machine 100. As shown, article 160 is shaped similarly to a sandal or slipper. Article 161 may be formed by using forming last 159. As shown, article 161 has a different shape than article 160. In this depiction, article 161 is similarly shaped to a low-top article of footwear. Therefore, a similarly shaped forming last may be used to form articles that have different shapes or designs. By varying the frequency of the interaction between threads 120 and the location of plurality of spools 102 as each forming mandrel is passed through braiding machine 100, different designs may be formed by using the same or similarly shaped forming lasts.

In some embodiments, differently sized and shaped forming lasts may be passed through braiding machine 100. In some embodiments, the differently sized and shaped forming lasts may be used to form articles of different sizes and shapes. For example, forming last 162, forming last 164 and forming last 166 may be shaped and sized differently. Forming last 162 may be used to form a portion of the upper of article 163. Article 163 may be shaped as a mid-top article of footwear. Forming last 164 may be used to form a portion of the upper of article 165. Article 165 may be shaped as a high-top article of footwear. Forming last 166 may be used to form a portion of the upper of article 167. Article 167 may be shaped as a boot. Therefore, by changing the shape and size of a forming last, various articles of footwear with various shapes and sizes may be formed.

In some embodiments, a single sized and shaped article may be used to form multiple types of articles. For example, forming last 166 may be utilized to form a boot-type article. In some embodiments, the large ankle and leg portion of forming last 166 may not be overbraided. In such embodiments, a portion of an article that is similar to a high-top article of footwear may be formed. In still further embodiments, even less of the ankle portion of forming last 166 may be overbraided. In such embodiments, a portion of article that is similar to a mid-top article may be formed. By varying the amount of forming last 166 that is overbraided, portions of various types of articles may be formed.

Generally, the types of braiding machines include lace braiding machines, axial braiding machines, and radial braiding machines. For the purpose of this Detailed Description, radial braiding machines and axial braiding machines include intermeshed horn gears. These horn gears include "horns" that are openings or slots within the horn gears. Each of the horns may be configured to accept a carrier or carriage. In this configuration, therefore, axial braiding machines and radial braiding machines are configured to form non-jacquard braided structures.

A carriage is a vessel that may be passed between various horn gears. The carriages may be placed within various horns in the horn gears of the radial braiding machine. As a first horn gear rotates, the other horn gears rotate as well because each of the horn gears is intermeshed with one another. As a horn gear rotates, the horns within each horn gear pass by one another at precise points. For example, a horn from a first horn gear passes by a horn from an adjacent second horn gear. In some embodiments, a horn of a horn gear may include a carriage. As the horn gear rotates, the adjacent horn gear may include an open horn. The carriage may pass to the open horn. The carriage may pass around the braiding machine from horn gear to horn gear, eventually traversing around the braiding machine. An example of a radial braiding machine and components of a radial braiding machine are discussed in Richardson, U.S. Pat. No. 5,257,571, granted Nov. 2, 1993, entitled "Maypole Braider Having a Three Under and Three Over Braiding Path," the entirety of which is hereby incorporated by reference.

Additionally, each carriage may hold a spool or bobbin. The spools include a thread, strand, yarn, or a similar material that may be braided together. The thread from the spools extends toward a braiding point. In some embodiments, the braiding point may be located in the center of the braiding machine. In some embodiments, the thread from the spools may be under tension such that the thread from the spools are generally aligned and may remain untangled.

Figure 14:
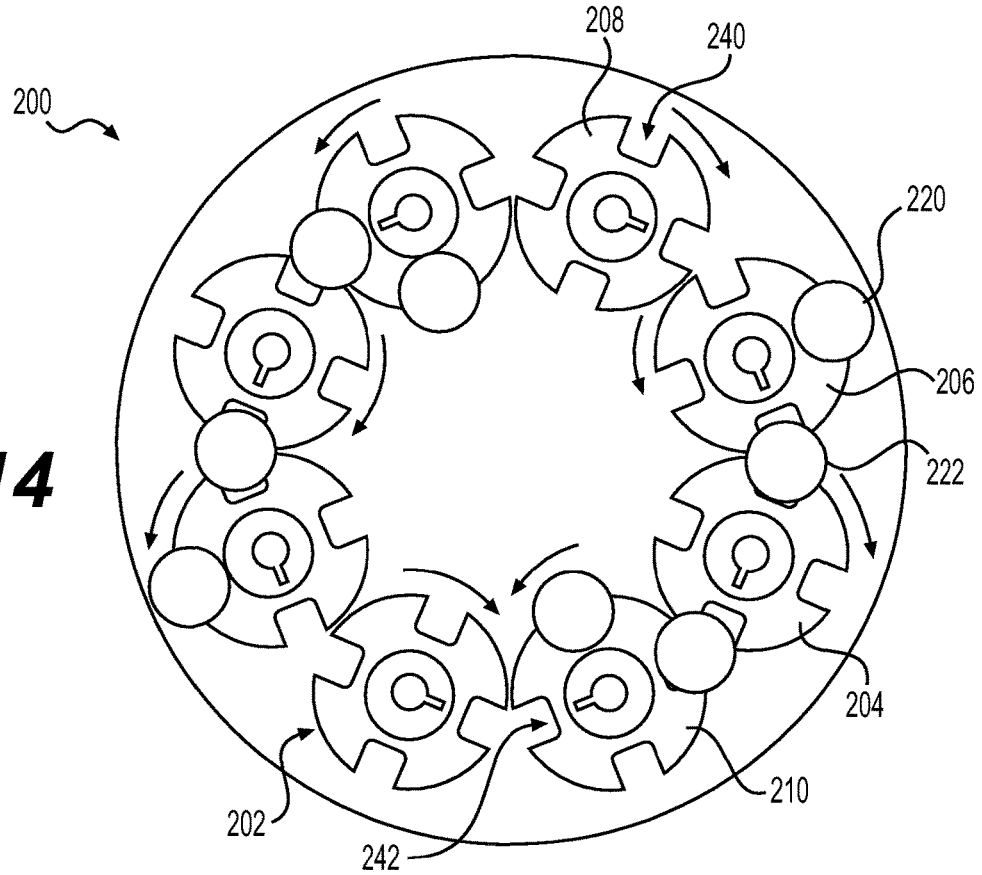
FIG. 14 is a schematic view of horn gears of a non-jacquard braiding machine.

As each carriage and spool combination is passed along the horn gears, the thread from each of the spools may intertwine. Referring to FIG. 14, a top schematic view of radial braiding machine 200 is depicted. Radial braiding machine 200 includes a plurality of horn gears 202. Each of the plurality of horn gears 202 includes an arrow indicating the direction in which the horn gear turns. For example, horn gear 204 rotates in a clockwise manner. In contrast, horn gear 206 rotates in a counterclockwise manner. As depicted, each of the horn gears rotates in the opposite direction of the adjacent horn gear. This is because the horn gears are intermeshed with one another. Therefore, radial braiding machine 200 is considered to be a fully non-jacquard machine.

Due to the intermeshing of the horn gears, each carriage and spool may take particular paths. For example, carriage 220, including a spool, rotates counterclockwise on horn gear 206. As horn gear 206 rotates counterclockwise, horn gear 208 may rotate clockwise. While each of the horn gears rotates, horn 240 may align with carriage 220. Because horn 240 is open, that is, horn 240 is not occupied by another carriage, horn 240 may accept carriage 220. Carriage 220 may continue on horn gear 208 and rotate in a clockwise manner until carriage 220 aligns with another open horn.

Additionally, other carriages may rotate in a different direction. For example, carriage 222, including a spool, may rotate clockwise on horn gear 204. Carriage 222 may eventually align with a horn 242 of horn gear 210 that is not occupied by a carriage. As carriage 222 aligns with horn 242, carriage 222 may pass onto horn gear 210. Once carriage 222 is on horn gear 210, carriage 222 may rotate counterclockwise on horn gear 210. Carriage 222 may continue on horn gear 210 until carriage 222 aligns with another open horn on an adjacent horn gear.

As the carriages extend around radial braiding machine 200, the thread from the spools located within the carriages may intertwine with one another. As the thread intertwines, a non-jacquard braided structure may be formed.

Figure 15:
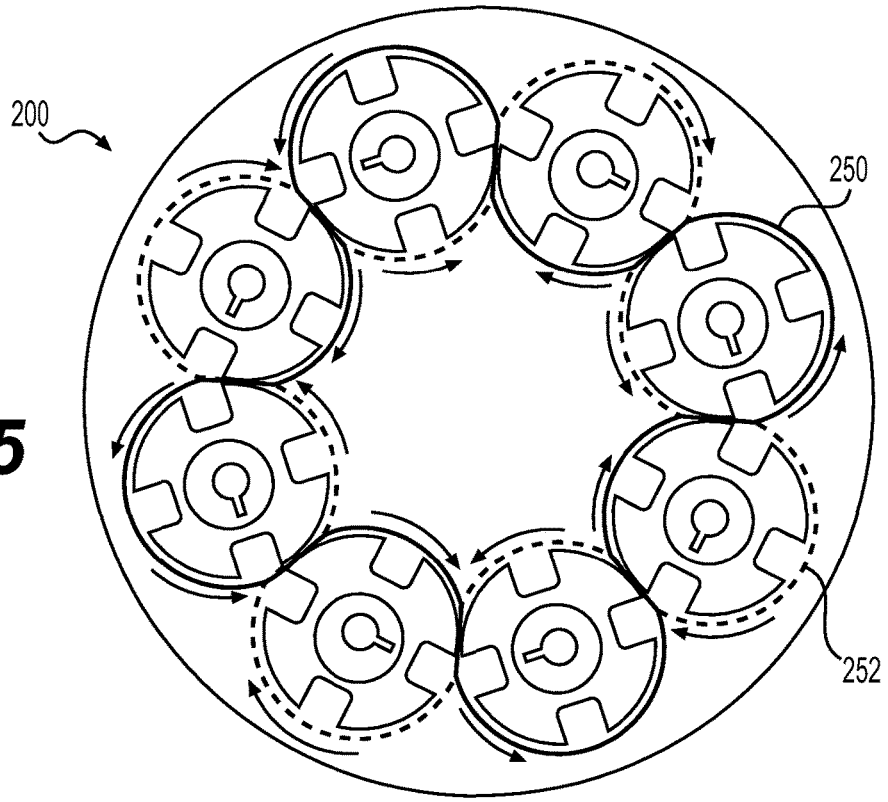
FIG. 15 is a schematic of a non-jacquard braiding machine depicting the path of spools.

Referring to FIG. 15, the general path of a carriage on radial braiding machine 200 is depicted. Path 250 indicates the path that carriage 220 may take. Path 252 indicates the path that carriage 222 may take. Although path 250 generally follows a counterclockwise rotation, it should be recognized that carriage 220 rotates locally in a clockwise and counterclockwise manner as carriage 220 passes from horn gear to horn gear. Additionally, path 252 generally follows a clockwise rotation; however, carriage 222 rotates locally in a clockwise and counterclockwise manner as carriage 222 passes between the horn gears. As shown, path 252 and path 250 are continuous around radial braiding machine 200. That is, path 252 and path 250 do not change overall direction around radial braiding machine 200.

In the configuration as shown, radial braiding machine 200 may not be configured to form intricate and customized designs of braided structures. Due to the construction of radial braiding machine 200, each carriage passes between plurality of horn gears 202 in largely the same path. For example, carriage 222 rotates clockwise around radial braiding machine 200 along path 252. Carriage 222 is generally fixed in this path. For example, carriage 222 generally cannot transfer onto path 250.

Additionally, the interaction and intertwining of strands on each of the carriages is generally fixed from the beginning of the braiding cycle. That is, the placement of carriages in the beginning of the braiding cycle may determine the formation of the braided structure formed by radial braiding machine 200. For example, as soon as the carriages are placed in specific horns within the horn gears, the pattern and interaction of the carriages is not altered unless radial braiding machine 200 is stopped and the carriages are rearranged. This means that the braided portion formed from a radial braiding machine 200 may form a repeating pattern throughout the braided portion that may be referred to as a non-jacquard braided portion. Additionally, this configuration does not allow for specific designs or shapes to be formed within a braided portion.

With reference to radial braiding machine 200, in some embodiments, the carriages placed within the horns or slots of plurality of horn gears 202 may be placed in predetermined locations. That is, the carriages may be placed so that as the horn gears of radial braiding machine 200 rotate, the carriages will not interfere with one another. In some embodiments, radial braiding machine 200 may be damaged if carriages are not preplaced in a particular arrangement. As the carriages extend from one horn gear to another, an open horn must be available at the junction of adjacent horn gears for the carriages to pass from one horn gear to another. If the horn of a horn gear is not open, the attempted transfer of carriages may cause damage to the radial braiding machine. For example, as shown in FIG. 14, horn 240 is not occupied by a carriage. If horn 240 were to be occupied by a carriage in the current configuration, carriage 220 would interfere with that carriage. In such a configuration, radial braiding machine 200 may be damaged due to the interference. The carriages may be particularly placed within horns such that interference between carriages may be avoided.

Figure 16:
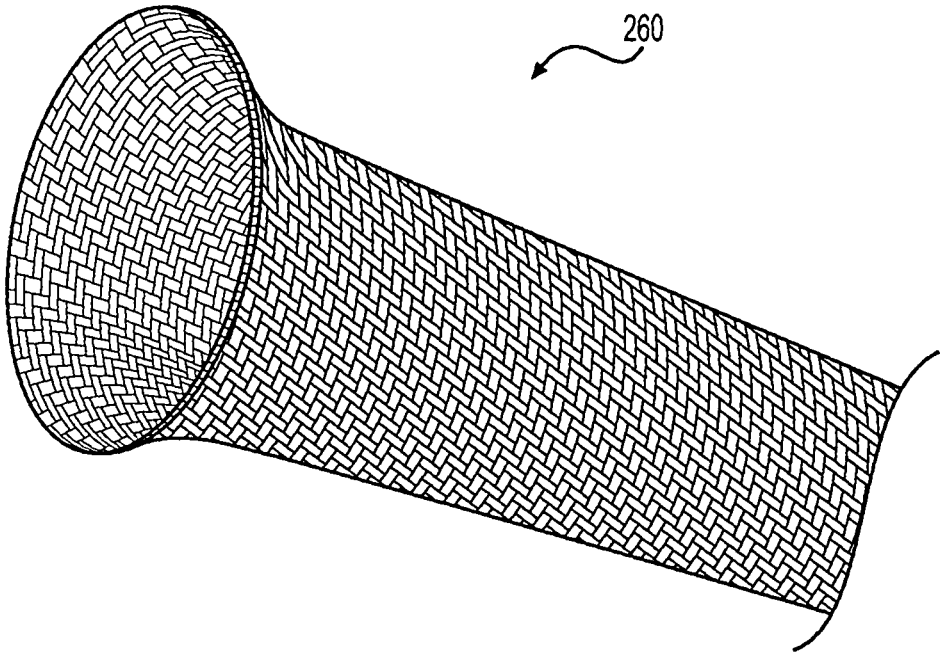
FIG. 16 is an embodiment of a braided tube formed using a non-jacquard braiding machine.

Referring to FIG. 16, a configuration of a braided structure formed from radial braiding machine 200 is depicted. As shown braided portion 260 is formed in a largely tubular shape. The same non-jacquard braid structure is depicted throughout the length of braided portion 260. Additionally, there are no holes, openings, or designs within the side of braided portion 260 that are parallel to the braiding direction. Rather, braided portion 260 depicts an opening at either end of braided portion 260. That is, the openings of braided portion 260 are only depicted in an area that is perpendicular to the braiding direction of radial braiding machine 200.

Referring to FIG. 17, a cutaway portion of braiding machine 100 is depicted. As shown, a portion of track 122 has been removed for ease of description. Additionally, plurality of spools 102 are shown located in gaps 104 between plurality of rotor metals 106. Gaps 104 may be the area or space between adjacent plurality of rotor metals 106. As discussed previously, plurality of rotor metals 106 may rotate and press or slide the spools to an adjacent gap.

In some embodiments, plurality of rotor metals 106 may be turned by motors. In some embodiments, plurality of rotor metals 106 may each be controlled by a motor. In other embodiments, plurality of rotor metals 106 may be controlled by various gears and clutches. In still further embodiments, plurality of rotor metals 106 may be controlled by another method.

Figure 18:
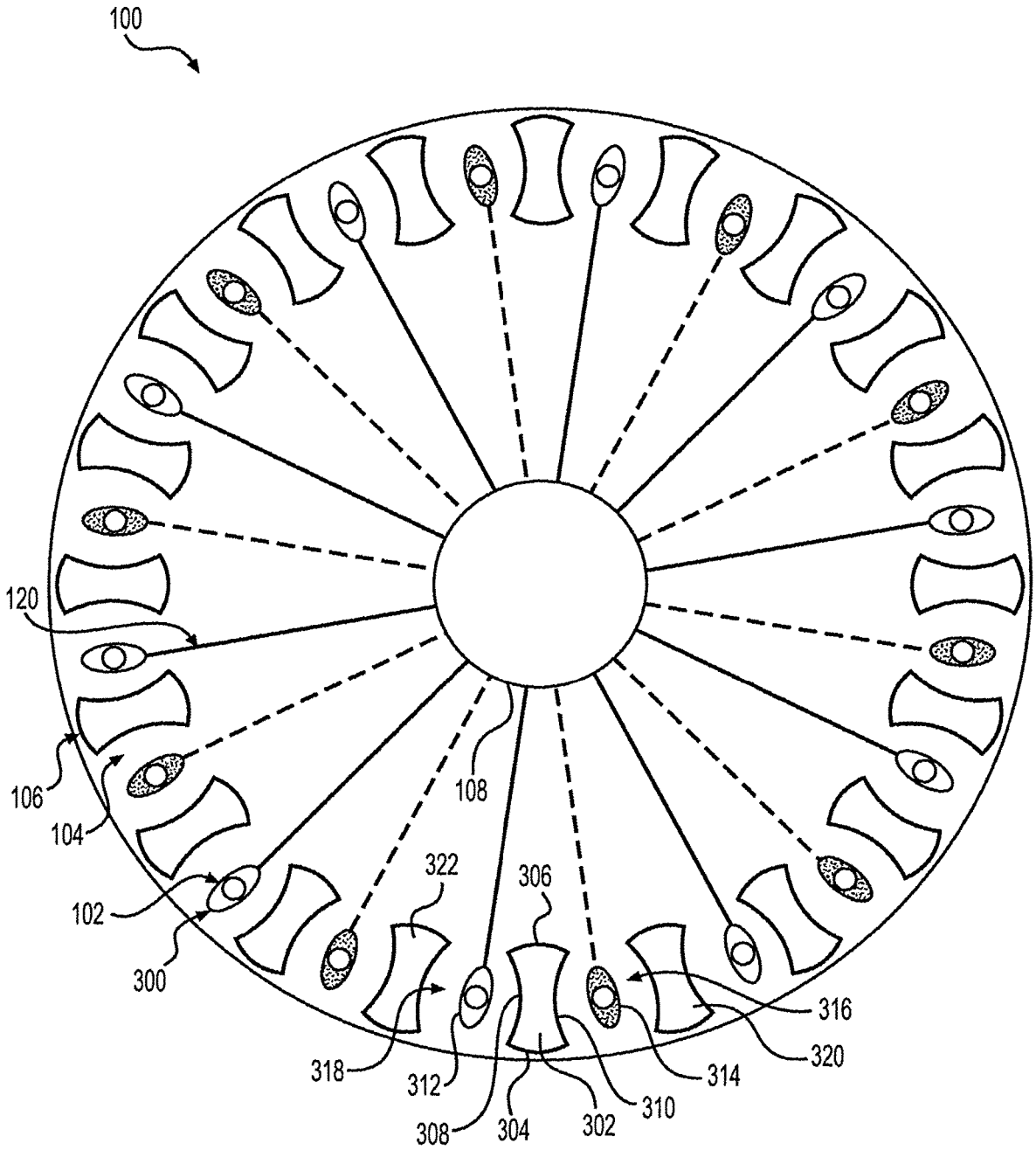
FIG. 18 is a top view of an embodiment of a braiding machine.

Referring to FIG. 18, a schematic of a top view of braiding machine 100 is depicted. Braiding machine 100 includes plurality of rotor metals 106 and a plurality of carriages 300. Each of the plurality of carriages 300 may include spools that include thread. As depicted, a plurality of spools 102 is arranged within the plurality of carriages 300. Additionally, threads 120 extend from each of the plurality of spools 102.

In some embodiments, the size of braiding machine 100 may be varied. In some embodiments, braiding machine 100 may be able to accept 96 carriages. In other embodiments, braiding machine 100 may be able to accept 144 carriages. In still further embodiments, braiding machine 100 may be able to accept 288 carriages or more. In further embodiments, braiding machine 100 may be able to accept between about 96 carriages and about 432 carriages. In still further embodiments, the number of carriages may be less than 96 carriages or over 432 carriages. By varying the number of carriages and spools within a braiding machine, the density of the braided structure as well as the size of the braided component may be altered. For example, a braided structure formed with 432 spools may be denser or include more coverage than a braided structure formed with fewer spools. Additionally, by increasing the number of spools, a larger-sized objected may be overbraided.

In some embodiments, plurality of rotor metals 106 may have various shapes. Each rotor metal may be evenly spaced from one another and is formed in the same shape. Referring particularly to rotor metal 302, in some embodiments, an upper and a lower end may include convex portions. As shown, rotor metal 302 includes first convex edge 304 and second convex edge 306. As shown, first convex edge 304 and second convex edge 306 extend away from a central portion of rotor metal 302. Additionally, first convex edge 304 is located on an opposite side of rotor metal 302 from second convex edge 306. In this position, first convex edge 304 and second convex edge 306 are oriented radially from ring 108. That is, first convex edge 304 faces an outer perimeter of braiding machine 100 and second convex edge 306 faces toward ring 108. In this configuration, rotor metal 302 is in a steady state or starting position. The orientation of first convex edge 304 and second convex edge 306 may change during use of braiding machine 100.

In some embodiments, the sides of the rotor metals may include concave portions. As depicted, rotor metal 302 includes first concave edge 308 and second concave edge 310. First concave edge 308 and second concave edge 310 may extend between first convex edge 304 and second convex edge 306. In such a configuration, rotor metal 302 may have a shape that is similar to a bowtie. In other embodiments, plurality of rotor metals 106 may have different or varying shapes.

The orientation of each carriage may vary during use of braiding machine 100. In this configuration, first concave edge 308 is located adjacent to carriage 312. Second concave edge 310 is located adjacent to carriage 314. As rotor metal 302 rotates, carriage 314 may interact with second concave edge 310 and carriage 312 may interact with first concave edge 308. By interacting with carriage 314, carriage 314 may be rotated away from gap 316 located between rotor metal 302 and rotor metal 320. Additionally, carriage 312 may be rotated away from gap 318 located between rotor metal 302 and rotor metal 322.

As shown, each rotor metal of plurality of rotor metals 106 is arranged along a perimeter portion of braiding machine 100. The even spacing of plurality of rotor metals 106 forms even and consistent gaps 104 between each of the plurality of rotor metals 106 along the perimeter of braiding machine 100. Gaps 104 may be occupied by plurality of carriages 300. In other embodiments, a portion of gaps 104 may be unoccupied or empty.

Figure 19:
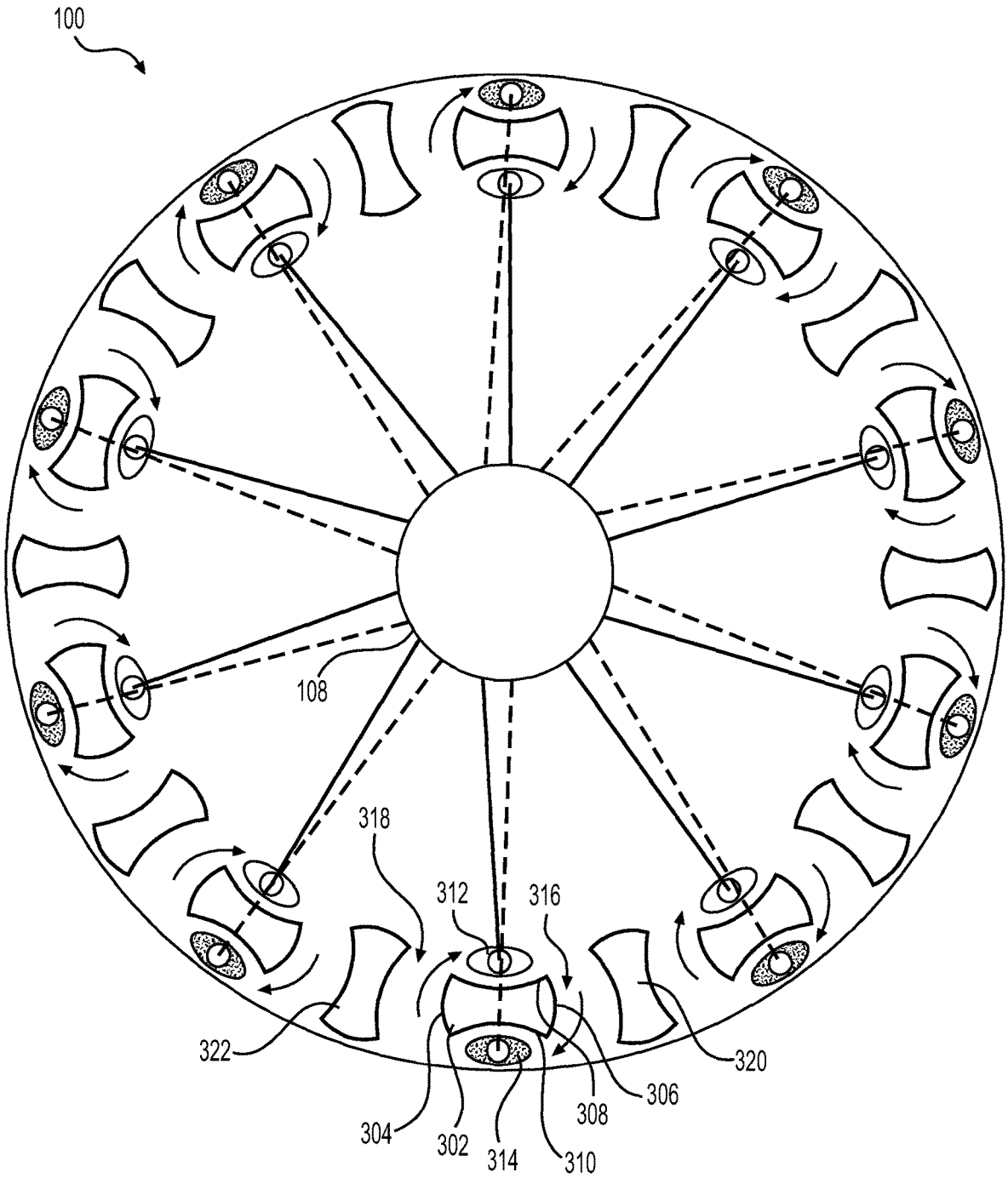
FIG. 19 is a top view of the process of rotating rotor metals of a braiding machine.

In contrast to radial braiding machines or fully non-jacquard machines, in a lace braiding machine, each rotor metal is not intermeshed with the adjacent rotor metal. Rather, each rotor metal may be selectively independently movable at opportune times. That is, each rotor metal may rotate independently from other rotor metals of braiding machine 100 when there is clearance for a motor to rotate. Referring to FIG. 19, every other rotor metal is depicted as rotating approximately 90 degrees in a clockwise direction from a first position to a second position. In contrast to braiding with a radial braiding machine, every rotor metal does not rotate. In fact, some rotor metals are not permitted to rotate. For example, rotor metal 302 rotates from a first position approximately 90 degrees clockwise to a second position. Adjacent rotor metal 320, however, may not be permitted to rotate as adjacent rotor metal 320 may collide with rotor metal 302 in the current position.

In some embodiments, the rotation of a rotor metal may assist in rotating carriages along the perimeter of braiding machine 100. Referring to rotor metal 302, second concave edge 310 may press against carriage 314. As rotor metal 302 contacts carriage 314, rotor metal 302 may press or push carriage 314 in a clockwise direction. As shown, carriage 314 is located between second concave edge 310 and the perimeter portion of braiding machine 100. Additionally, carriage 312 may rotate clockwise as well. First concave edge 308 may press against carriage 312 and push or force carriage 312 to rotate clockwise. In this configuration, carriage 312 may be located between rotor metal 302 and ring 108.

In some embodiments, portions of rotor metals may enter into gaps located between each of the rotor metals. In some embodiments, the convex portions of a rotor metal may be located within the gaps between rotor metals. As shown in FIG. 19, second convex edge 306 may be partially located within gap 316. Additionally, first convex edge 304 may be partially located within gap 318. In this configuration, therefore, rotor metal 322 and rotor metal 320 may be restricted from rotating because each of the rotor metals may contact rotor metal 302.

Figure 20:
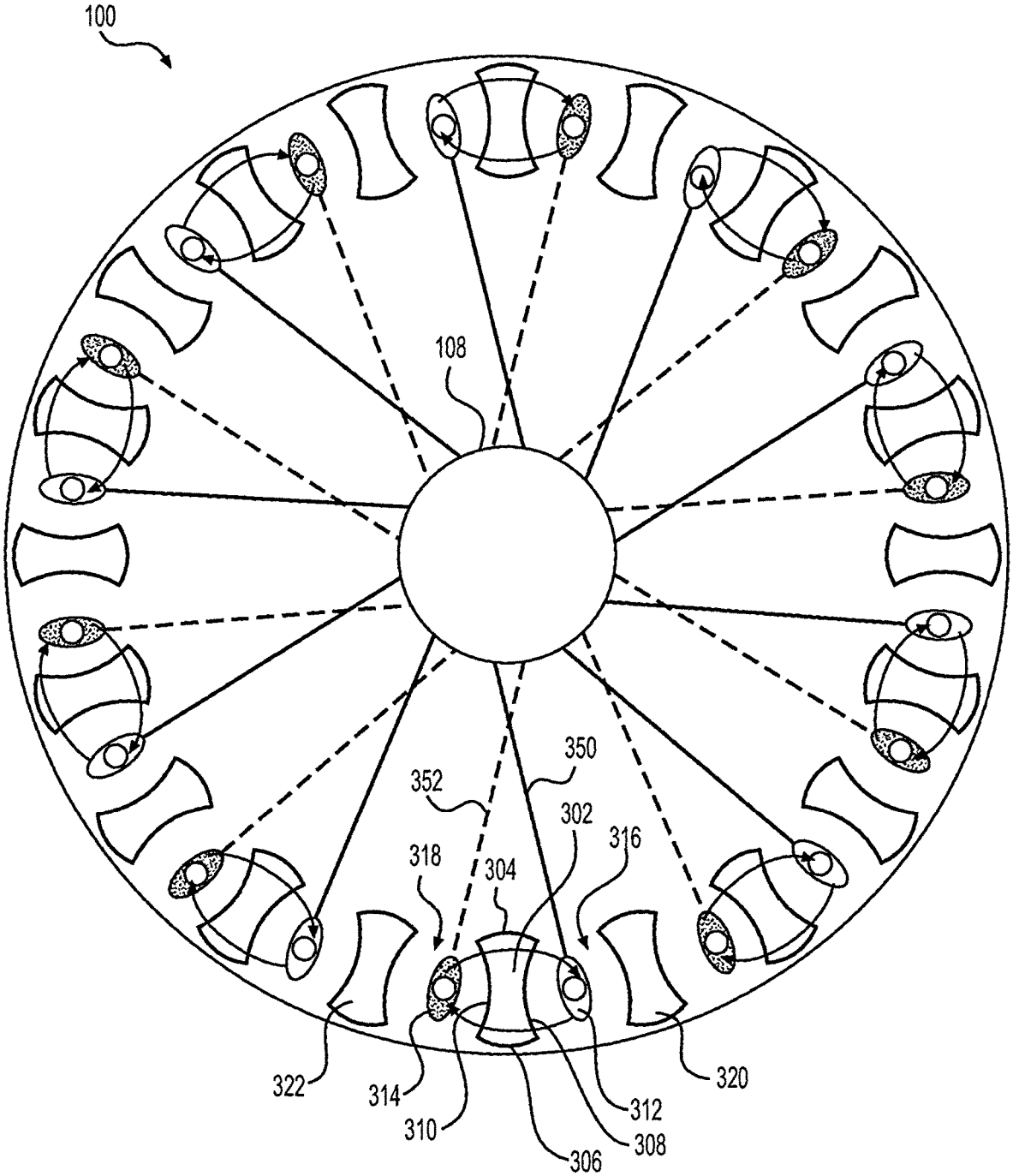
FIG. 20 is a top view of the process of rotor metals completing a half rotation in a braiding machine.

Referring to FIG. 20, half of the rotor metals have complete a 180-degree rotation. For example, rotor metal 302 has completed a 180-degree rotation. In this configuration, second convex edge 306 now faces the perimeter of braiding machine 100. First convex edge 304 now faces ring 108. Further, carriage 312 now occupies gap 316. Additionally, carriage 314 now occupies gap 318. In this configuration, carriage 314 and carriage 312 have exchanged places from the configuration depicted in FIG. 18.

In some embodiments, as the carriages pass by one another, the strand or thread from the spools located within the carriages may intertwine. As shown in FIG. 20, strand 350 from the spool of carriage 312 may intertwine with strand 352 from the spool of carriage 314. Additionally, the strands from other carriages may also intertwine. In this manner, a braided structure may be formed through the interaction and intertwining of various strands from the spools located within the carriages of braiding machine 100.

In some embodiments, the number of carriages and spools within braiding machine 100 may be varied. For example, in some embodiments, many gaps 104 may remain unoccupied. By not filling a gap with a carriage and spool, different designs and braided structures may be formed. In some embodiments, by not including spools in certain locations, holes or openings may be formed in a braided structure or component.

In some embodiments, each rotor metal may rotate at opportune times. For example, in the configuration shown in FIG. 20, rotor metal 322 may rotate. While rotor metal 322 begins to rotate, rotor metal 302 may not rotate so as to avoid a collision between rotor metal 322 and rotor metal 302. When rotor metal 322 rotates, rotor metal 322 may press against carriage 314 and move carriage 314 in the same manner as rotor metal 302 moved carriage 314. Strand 352 may then interact and intertwine with a different strand and form a different braided design. Other carriages may similarly be acted upon to form various braided elements within a braided structure.

In some embodiments, some carriages may individually rotate counterclockwise. In some embodiments, rotor metal 322 and rotor metal 320 may rotate counterclockwise. Additionally, every other rotor metal may also rotate counterclockwise. In such a configuration, a braided structure may be formed that is similar in appearance to a braided structure formed on radial braiding machine 200. This type of motion may be considered a non-jacquard motion. A non-jacquard motion may form a non-jacquard braid structure. For example, in some configurations, every other rotor metal from rotor metal 302 may be configured to rotate clockwise at opportune times. Every other rotor metal from rotor metal 322 may be configured to rotate counterclockwise at opportune times. In this configuration, as rotor metal 322 rotates counterclockwise, rotor metal 322 may locally rotate carriage 314 counterclockwise. Additionally, as rotor metal 320 rotates counterclockwise, rotor metal 320 may contact carriage 312 and locally rotate carriage 312 counterclockwise. In such a configuration, however, carriage 314 may be rotating clockwise around the perimeter of braiding machine 100. Carriage 312 may be rotating counterclockwise around the perimeter of braiding machine 100. In this manner, carriage 312 may be rotating in a path similar to path 250 of FIG. 15. Additionally, carriage 314 may be rotating in a path similar to path 252 of FIG. 15. As such, braiding machine 100 may be configured to mimic or recreate the non-jacquard motion of radial braiding machine 200 and form non-jacquard structures within a braided portion. In such configurations, braiding machine 100 may be configured to form braided structures that are similar to those braided structures formed on radial braiding machine 200.

Although braiding machine 100 may be configured to mimic the motion of a radial braiding machine and thereby form non-jacquard portions, it should be recognized that braiding machine 100 is not forced to mimic the motion of radial braiding machine 200. For example, plurality of rotor metals 106 may be configured to rotate both clockwise and counterclockwise. For example, rotor metal 302 may be configured to rotate both clockwise and counterclockwise. In other embodiments, each rotor metal of plurality of rotor metals 106 may be configured to rotate both clockwise and counterclockwise. By rotating clockwise and counterclockwise, braiding machine 100 may be able to form designs and unique braided structures within a braided component that radial braiding machine 200 may be incapable of forming.

Figure 21:
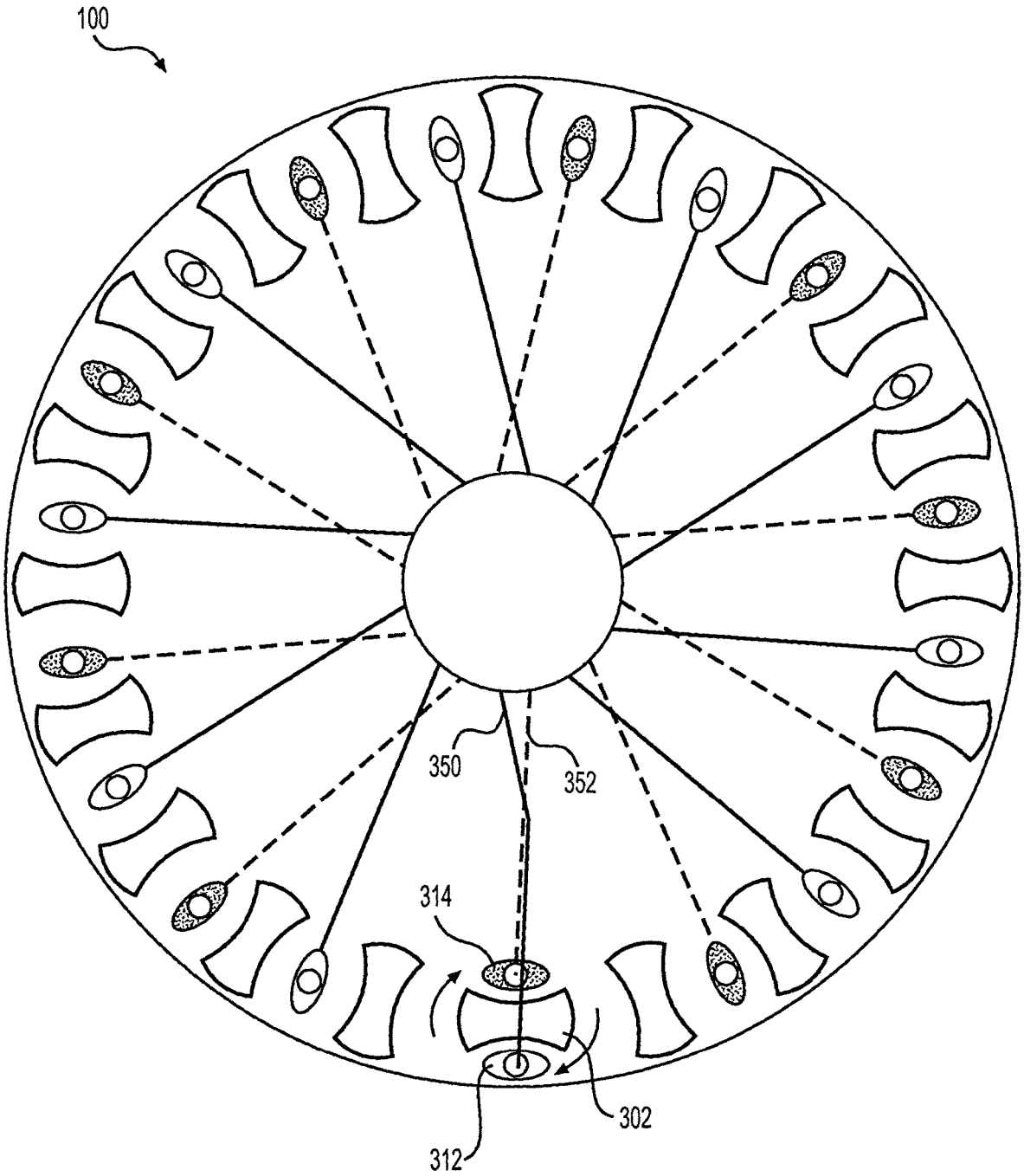
FIG. 21 is a top view of a single rotor metal rotating in a braiding machine.
Figure 22:
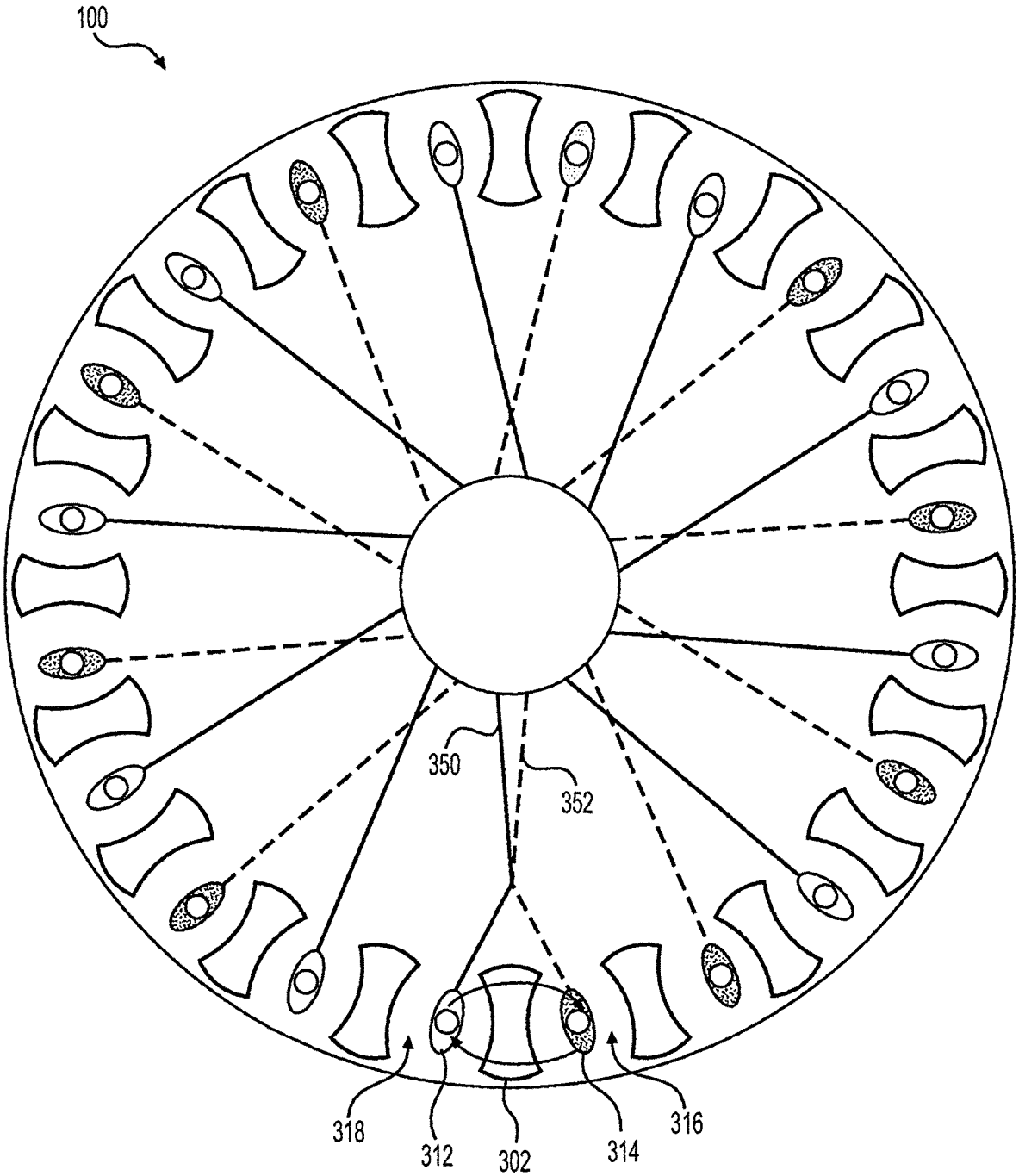
FIG. 22 is a top view of single rotor metal completing a one-half revolution.

Referring to FIGS. 21 and 22, an individual rotor metal may rotate. As shown, rotor metal 302 rotates clockwise and interacts with carriage 314 and carriage 312. Carriage 314 may be moved to occupy gap 316. Additionally carriage 312 may be moved to occupy gap 318. In this configuration, strand 350 may twist around strand 352. In this manner, rotor metal 302 may assist in forming a jacquard braided structure that may not be formed on radial braiding machine 200. Additionally, other rotor metals may rotate in a similar manner to form intricate patterns and designs that may not be possible on a radial braiding machine.

Figure 23:
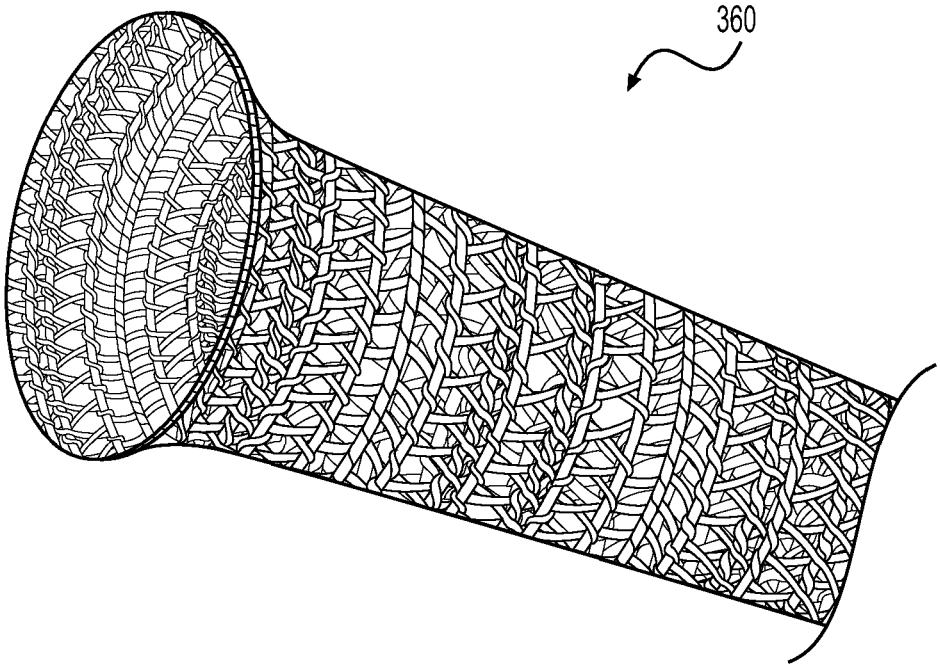
FIG. 23 is a schematic of a tube formed on the braiding machine.

Referring to FIG. 23, an article that is formed using a lace braiding machine is depicted. In contrast to braided portion 260 of FIG. 16, braided portion 360 includes an intricate jacquard braided structure. While braided portion 260 is formed of a consistent and repeating non-jacquard braided structure, braided portion 360 includes multiple different designs and intricate braided structures. Braided portion 360 may include openings within braided portion 360 along the braiding direction as well as tightly braided areas with a high density of strands or thread.

Referring to FIG. 24, an article of footwear that may be formed as a unitary piece using a lace braiding machine is depicted. Article 370 may include various design features that may be incorporated into article 370 during the braiding process. In some embodiments, lace aperture 372, lace aperture 374, lace aperture 376, and lace aperture 378 may be formed during the manufacturing process.

In some embodiments, article 370 may incorporate areas of high-density braid as well as areas of low-density braid. For example, area 380 may be formed with a high-density braided configuration. In some embodiments, area 380 may be a non-jacquard area that is formed during a non-jacquard motion of spools within braiding machine 100. In some embodiments, high-density areas may be located in areas of article 370 that are likely to experience higher levels of force. For example, in some embodiments, area 380 may be located adjacent a sole structure. In other embodiments, area 380 may be located in various areas for design and aesthetic reasons. Additionally, in some embodiments, lower density braid 382 may be located throughout article 370. In some embodiments, lower density braid 382 may be a jacquard area formed during a jacquard motion of spools within braiding machine 100. In some embodiments, lower density braid 382 may extend between and connect areas of high-density braid or non-jacquard areas. In other embodiments, lower density braid 382 may be located in areas of article 370 that may be configured to stretch. In other embodiments, lower density braid 382 may be placed in areas for aesthetic and design purposes.

In some embodiments, different techniques may be used to form different densities of braided structures. For example, in some embodiments, a jacquard area may have a higher density than a non-jacquard area. As discussed previously, varying rate of rotation of the spools as well as the rate of extension of a braided component may assist in varying the density of the braided component.

In some embodiments, article 370 may be formed using a seamless braided upper. As discussed previously, braiding machine 100 may be used to form different braided shapes and structures. In some embodiments, the upper of article 370 may be formed using a lace braiding machine to form a seamless configuration of higher density areas and lower density areas.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A system for forming braided structures over objects, the system comprising:

a braiding machine, comprising:

a support structure comprising an enclosure and a track extending around the enclosure;

a plurality of spools with thread positionable along the track;

a passageway extending through the enclosure, the passageway having a first opening at a first end of the passageway and a second opening at a second end of the passageway, a braiding point located proximate the second opening of the passageway; and a conveyor spaced from the braiding machine, wherein the braiding machine and the conveyor are positioned so that as an object is advanced through the passageway and from a first side of the braiding point to a second side of the braiding point while the plurality of spools with the thread are moved around the track, the thread is deposited about the object to form a braided structure thereon and the object with the braided structure formed thereon is advanced onto the conveyor.

2. The system of claim 1, further comprising a thread tensioner coupled to the braiding machine between the track and the braiding point.

3. The system of claim 1, wherein the passageway is non-linear between the first opening and the second opening.

4. The system of claim 1, wherein the conveyor comprises a belt.

5. The system of claim 4, wherein a plane defined by the belt is oriented perpendicular to an axis of the braiding point.

6. The system of claim 1, wherein the object comprises a first object of a plurality of objects, and wherein the plurality of objects are movably coupled together in sequence with a plurality of flexible connection mechanisms that are respectively interposed between the plurality of objects.

7. The system of claim 1, further comprising a thread-organization ring coupled to the braiding machine.

8. The system of claim 7, wherein the thread-organization ring is removably coupled to the braiding machine, and wherein the thread-organization ring is replaceable with any one of a plurality of other thread-organization rings of different sizes.

9. The system of claim 1, wherein the object is a shoe last, and wherein the braided structure is a braided shoe upper.

10. A system for forming braided structures over objects, the system comprising:

a braiding machine, comprising:

a support structure comprising an enclosure and a track extending around the enclosure;

a plurality of spools with thread positionable along the track;

a passageway extending through the enclosure, the passageway having a first opening at a first end of the passageway and a second opening at a second end of the passageway, wherein the passageway is non-linear, a braiding point located proximate the second opening of the passageway; and a plurality of objects on which braided structures can be formed by the braiding machine, the plurality of objects movably coupled together in sequence with a plurality of respectively interposed flexible connection mechanisms, wherein each one of the plurality of respectively interposed flexible connection mechanisms comprises a non-rigid, pliable material.

11. The system of claim 10, wherein the braiding machine is configured so that as each one of the plurality of objects is advanced through the passageway and from a first side of the braiding point to a second side of the braiding point while the plurality of spools with the thread are moved around the track, the thread is deposited on each one of the plurality of objects to form a braided structure thereon.

12. The system of claim 10, further comprising a thread tensioner coupled to the braiding machine between the track and the braiding point.

13. The system of claim 10, wherein the plurality of objects comprises a plurality of shoe lasts.

14. The system of claim 13, wherein the plurality of shoe lasts are all of a common size.

15. The system of claim 13, wherein the plurality of shoe lasts comprises at least two shoe lasts of different sizes.

16. The system of claim 10, further comprising a conveyor spaced from the braiding machine, wherein the plurality of objects with the braided structures formed thereon are advanced onto the conveyor during a braiding process.

17. The system of claim 10, wherein the plurality of respectively interposed flexible connection mechanisms are each formed of rubber.

18. A system for forming braided structures over objects, the system comprising:

a braiding machine, comprising:

a support structure comprising an enclosure and a track extending around the enclosure;

a plurality of spools each having a tensile element and positionable along the track;

a passageway extending through the enclosure, the passageway having a first opening at a first end of the passageway and a second opening at a second end of the passageway, a braiding point located proximate the second opening of the passageway; and a conveyor spaced from the braiding machine, wherein the braiding machine and the conveyor are positioned so that as an object is advanced through the passageway and from a first side of the braiding point to a second side of the braiding point while the plurality of spools each having the tensile element are moved around the track, the tensile element is deposited about the object to form a braided structure thereon and the object with the braided structure formed thereon is advanced onto the conveyor.

* * * * *